US008995854B2

(12) United States Patent
Ishida

(10) Patent No.: US 8,995,854 B2
(45) Date of Patent: Mar. 31, 2015

(54) RECORDING MATERIAL DETERMINATION APPARATUS AND IMAGE FORMING APPARATUS

(75) Inventor: Tsutomu Ishida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 300 days.

(21) Appl. No.: 13/571,195

(22) Filed: Aug. 9, 2012

(65) Prior Publication Data

US 2013/0039672 A1 Feb. 14, 2013

(30) Foreign Application Priority Data

Aug. 12, 2011 (JP) ..... 2011-177142
Jul. 11, 2012 (JP) ..... 2012-155506

(51) Int. Cl.
*G03G 15/00* (2006.01)

(52) U.S. Cl.
CPC ..... *G03G 15/5029* (2013.01)
USPC ..... 399/45

(58) Field of Classification Search
CPC ..... G03G 15/5029
USPC ..... 399/45
See application file for complete search history.

(56) References Cited

U.S. PATENT DOCUMENTS

| | | | | |
|---|---|---|---|---|
| 8,045,868 | B2 * | 10/2011 | Kuramochi et al. | 399/45 |
| 2009/0310992 | A1 * | 12/2009 | Iwasa et al. | 399/45 |
| 2013/0148990 | A1 * | 6/2013 | Kuramochi et al. | 399/45 |

FOREIGN PATENT DOCUMENTS

| | | | |
|---|---|---|---|
| JP | 2004-107030 | A | 4/2004 |
| JP | 2004-219856 | A | 8/2004 |
| JP | 2009-29622 | A | 2/2009 |
| JP | 2009-113926 | A | 5/2009 |
| JP | 2011-37524 | A | 2/2011 |

* cited by examiner

*Primary Examiner* — Susan Lee
(74) *Attorney, Agent, or Firm* — Canon U.S.A., Inc., IP Division

(57) ABSTRACT

A recording material determination apparatus includes a transmission unit configured to transmit an ultrasonic wave, a reception unit configured to receive an ultrasonic wave transmitted from the transmission unit and then via a recording material, and a control unit configured to cause the transmission unit to transmit an ultrasonic wave a plurality of times under different conditions, measure an output value a plurality of times, and determine the recording material based on the output values measured a plurality of times.

22 Claims, 25 Drawing Sheets

BOND PAPER

PLAIN PAPER

BOND PAPER

PLAIN PAPER

BOND PAPER

PLAIN PAPER

PLAIN PAPER

GLOSS PAPER

PLAIN PAPER

GLOSS PAPER

PLAIN PAPER

GLOSS PAPER

BOND PAPER

PLAIN PAPER

PLAIN PAPER

GLOSS PAPER

RECORDING MATERIAL DETERMINATION APPARATUS AND IMAGE FORMING APPARATUS

BACKGROUND OF THE INVENTION

1. Field of the Invention

The present invention relates to a recording material determination apparatus determining a type of recording material, and an image forming apparatus with the recording material determination apparatus mounted thereon.

2. Description of the Related Art

Some of conventional image forming apparatuses such as copiers or laser printers include a sensor for determining a type of recording material therein. The sensor is used to determine a type of recording material, and image forming conditions such as a transfer condition and/or a fixing condition are set according to the determination result.

A recording material determination apparatus using an ultrasonic wave is proposed as one of the methods for determining a type of recording material. In Japanese Patent Application Laid-Open No. 2004-107030, a type of recording material is determined by emitting an ultrasonic wave to the recording material, receiving an ultrasonic wave reflected from the recording material, and measuring a reflectance of the ultrasonic wave reflected from the recording material. Further, there is discussed a method for determining the thickness of a recording material by receiving an ultrasonic wave transmitted through the recording material and measuring a transmittance of the ultrasonic wave transmitted through the recording material.

In addition, Japanese Patent Application Laid-Open No. 2004-219856 discusses a method for detecting a surface property of a recording material by receiving an ultrasonic wave transmitted through the recording material and determining a transmittance of the recording material.

However, while the method of Japanese Patent Application Laid-Open No. 2004-219856 can detect a surface property of the recording material at one point, there is a possibility that the detection result will not be suitable as the detection result over the entire recording material. In general, a surface property or a grammage is not uniform over the entire recording material but is uneven in the recording material. Therefore, there is a possibility that the detection result at one point of the recording material will not be equal to the detection result over the entire recording material.

SUMMARY OF THE INVENTION

An aspect of the present invention is directed to a recording material determination apparatus and an image forming apparatus with the recording material determination apparatus mounted thereon capable of detecting a surface property of a recording material at high accuracy in consideration of an evenness of the recording material by using an ultrasonic wave transmitted through the recording material.

According to an aspect of the present invention, a recording material determination apparatus includes a transmission unit configured to transmit an ultrasonic wave, a reception unit configured to receive an ultrasonic wave transmitted from the transmission unit and then via a recording material, and a control unit configured to cause the transmission unit to transmit an ultrasonic wave a plurality of times under different conditions, measure an output value a plurality of times, and determine the recording material based on the output values measured a plurality of times.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

In addition, the following exemplary embodiments are not intended to limit the inventions of claims. Also, all combinations of features described in the present exemplary embodiments are not necessarily required for the solution of the invention.

Figure 1:
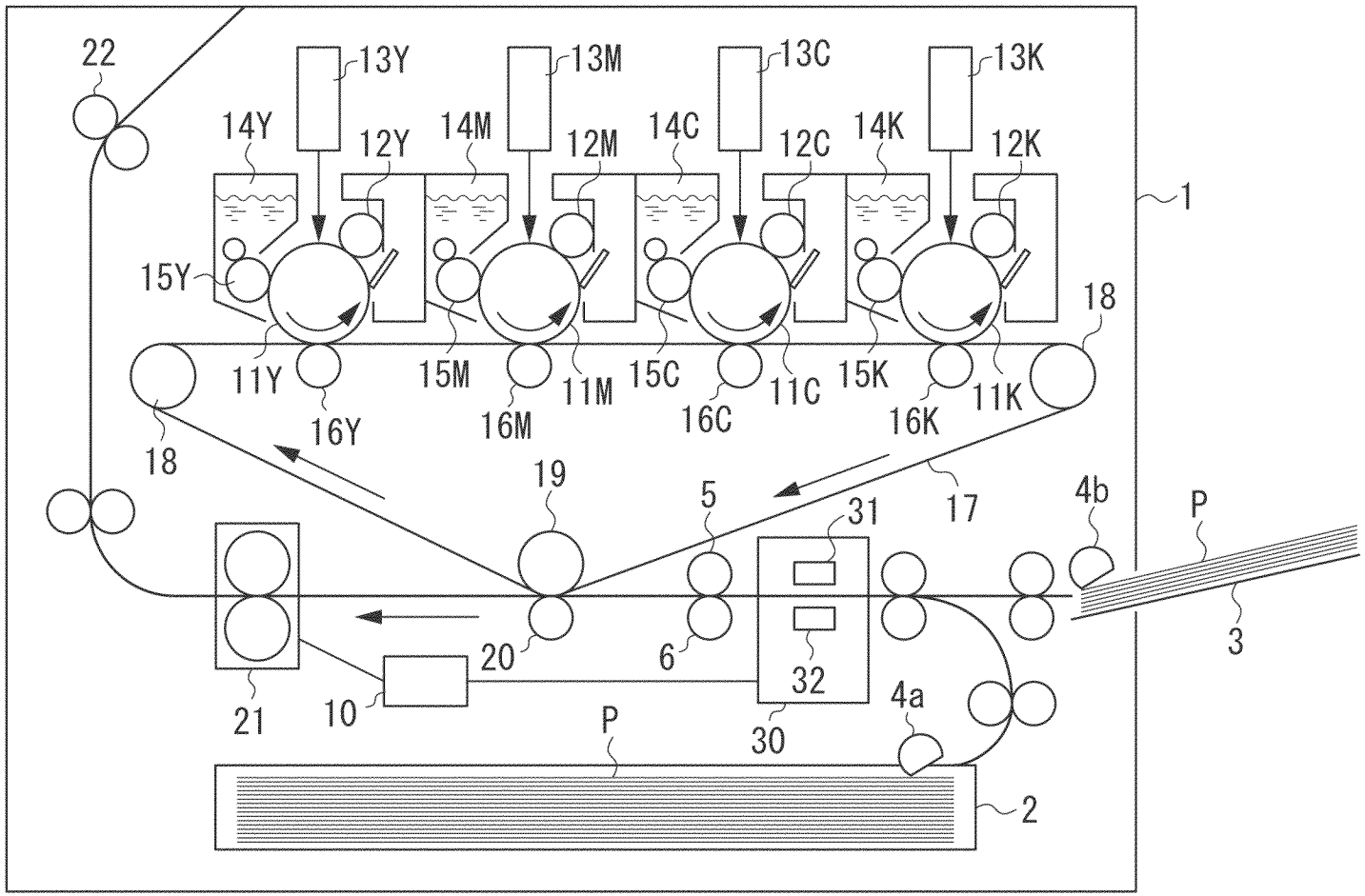
FIG. 1 is a schematic configuration diagram of an image forming apparatus.

A recording material determination apparatus according to the present exemplary embodiment can be used in, for example, an image forming apparatus such as a copier or a printer. FIG. 1 illustrates, as an example thereof, an image forming apparatus with a recording material determination apparatus mounted thereon. FIG. 1 is a schematic configuration diagram of an image forming apparatus that employs an intermediate transfer belt and includes a plurality of parallel image forming units.

The respective configurations of an image forming apparatus 1 in FIG. 1 are as follows. A paper feed cassette 2 stores a recording material P. A paper feed tray 3 is loaded with a recording material P. A paper feed roller 4*a* feeds the recording material P from the paper feed cassette 2. A paper feed roller 4*b* feeds the recording material P from the paper feed tray 3. A conveyance roller 5 conveys the fed recording material P, and a conveyance counter roller 6 faces the conveyance roller 5.

Photosensitive drums 11Y, 11M, 11C, and 11K bear yellow, magenta, cyan, and black developers respectively. Charging rollers 12Y, 12M, 12C, and 12K are charging rollers (primary charging units) for the respective colors, which are configured to charge the photosensitive drums 11Y, 11M, 11C, and 11K to a predetermined potential. Optical units 13Y, 13M, 13C, and 13K are configured to irradiate the photosensitive drums 11Y, 11M, 11C, and 11K charged by the primary charging units with laser beams corresponding to image data of the respective colors, and form an electrostatic latent image on each of the photosensitive drums 11Y, 11M, 11C, and 11K.

Developing units 14Y, 14M, 14C, and 14K are configured to visualize the electrostatic latent image formed on each of the photosensitive drums 11Y, 11M, 11C, and 11K. Developer conveyance rollers 15Y, 15M, 15C, and 15K are configured to send developers in the developing units 14Y, 14M, 14C, and 14K to portions facing the photosensitive drums 11Y, 11M, 11C, and 11K.

Primary transfer rollers 16Y, 16M, 16C, and 16K for the respective colors primarily transfer the image formed on each of the photosensitive drums 11Y, 11M, 11C, and 11K. An intermediate transfer belt 17 bears the primarily transferred image. A drive roller 18 drives the intermediate transfer belt 17.

A secondary transfer roller 19 is configured to transfer the image formed on the intermediate transfer belt 17 to the recording material P, and a secondary transfer counter roller 20 faces the secondary transfer roller 19. A fixing unit 21 fuses and fixes a developer image transferred to the recording material P, while conveying the recording material P. A paper discharge roller 22 discharges the recording material P that is image-fixed by the fixing unit 21.

In addition, the photosensitive drums 11Y, 11M, 11C, and 11K, the charging rollers 12Y, 12M, 12C, and 12K, the developing units 14Y, 14M, 14C, and 14K, and the developer conveyance rollers 15Y, 15M, 15C, and 15K are united for each color. This unification of the photosensitive drum, the charging roller, and the developing unit is referred to as a cartridge. The cartridges of the respective colors are configured to be easily attachable/detachable to/from an image forming apparatus body.

Next, an image forming operation of the image forming apparatus 1 will be described. Print data including a print command, image information, or the like is input to the image forming apparatus 1 from a host computer (not illustrated) or the like. Then, the image forming apparatus 1 starts a print operation, and a recording material P is fed by the paper feed roller 4*a* or the paper feed roller 4*b* from the paper feed cassette 2 or the paper feed tray 3, and is sent to a conveyance path.

In order to synchronize the timing of conveyance and an operation of forming an image on the intermediate transfer belt 17, the recording material P temporarily stops and waits at the conveyance roller 5 and the conveyance counter roller 6 until an image forming operation is performed. Together with the operation of feeding the recording material P, as an image forming operation, the photosensitive drums 11Y, 11M, 11C, and 11K are charged by the charging rollers 12Y, 12M, 12C, and 12K to a predetermined potential.

In synchronization with the input print data, the optical units 13Y, 13M, 13C, and 13K each form an electrostatic latent image by exposing thereof to a laser beam and scanning each of the surfaces of the charged photosensitive drums 11Y, 11M, 11C, and 11K with the laser beam.

In order to visualize the formed electrostatic latent images, development is performed by the developing units 14Y, 14M, 14C, and 14K and the developer conveyance rollers 15Y, 15M, 15C, and 15K. The electrostatic latent images respectively formed on the surfaces of the photosensitive drums 11Y, 11M, 11C, and 11K are developed by the developing units 14Y, 14M, 14C, and 14K as an image of the respective colors.

The photosensitive drums 11Y, 11M, 11C, and 11K contact with the intermediate transfer belt 17, and rotate in synchronization with the rotation of the intermediate transfer belt 17. The respective developed images are sequentially transferred by the primary transfer rollers 16Y, 16M, 16C, and 16K onto the intermediate transfer belt 17 in an overlapping manner. Then, the image is secondarily transferred by the secondary transfer roller 19 and the secondary transfer counter roller 20 onto the recording material P.

Thereafter, in order to perform a secondary transfer onto the recording material P in synchronization with an image forming operation, the recording material P is conveyed to a secondary transfer unit. The image formed on the intermediate transfer belt 17 is transferred by the secondary transfer roller 19 and the secondary transfer counter roller 20 to the recording material P.

The developer image transferred to the recording material P is fixed by the fixing unit 21 including a fixing roller and the like. The image-fixed recording material P is discharged by the paper discharge roller 22 to a paper discharge tray (not illustrated), thereby completing the image forming operation.

In the image forming apparatus 1 in FIG. 1, a recording material determination apparatus 30 according to the present exemplary embodiment is disposed upstream of the conveyance roller 5 and the conveyance counter roller 6, and information reflecting the type of the recording material P conveyed from the paper feed cassette 2 or the like can be detected.

In the present exemplary embodiment, determination by the recording material determination apparatus 30 is performed when a recording material P is sent from the paper feed cassette 2 or the like into the image forming apparatus 1 and is conveyed before being pinched by the conveyance roller 5 and the conveyance counter roller 6. Alternatively, determination by the recording material determination apparatus 30 is performed when the recording material P is pinched and conveyed by the conveyance roller 5 and the conveyance counter roller 6.

Figure 2:
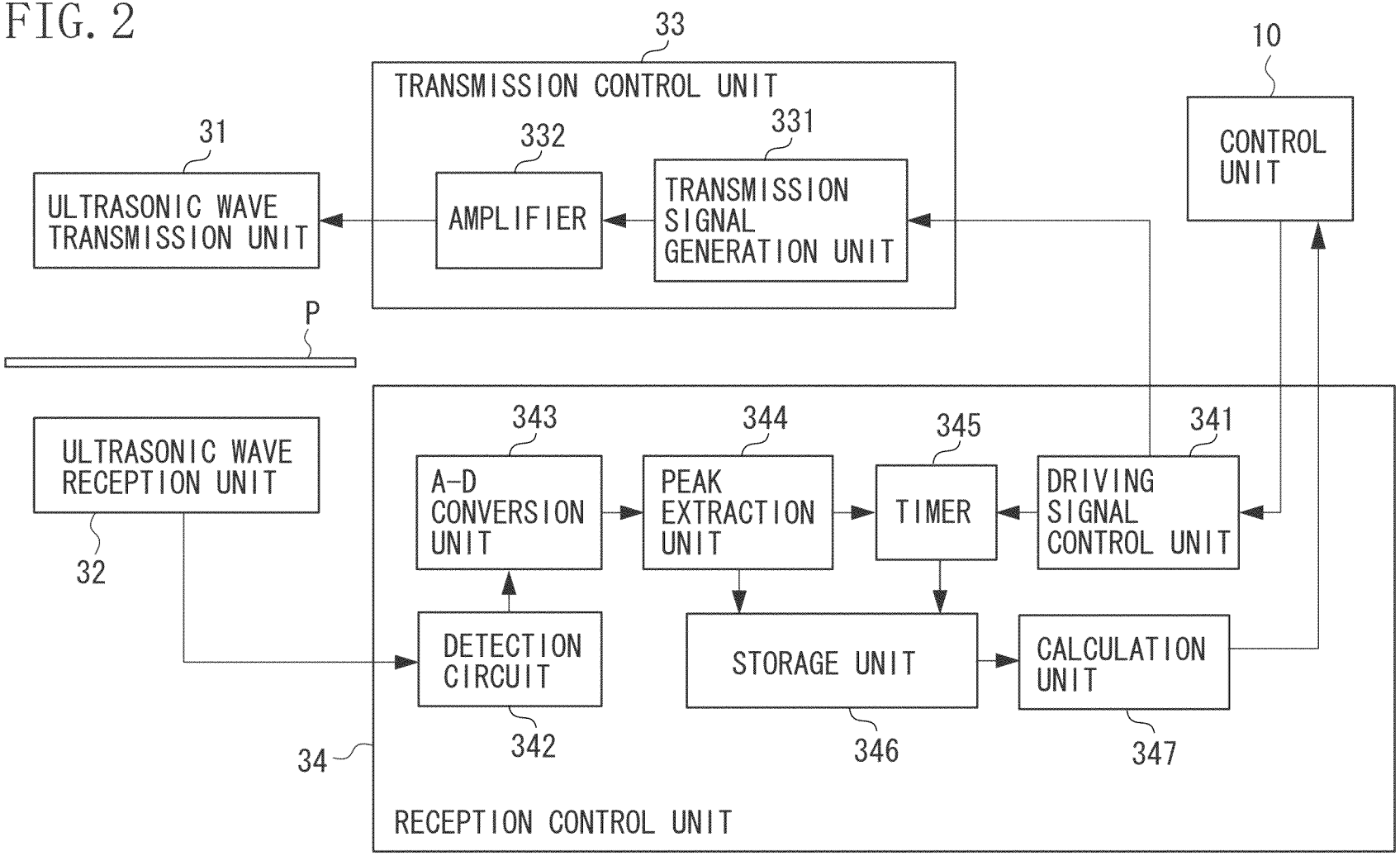
FIG. 2 is a block diagram illustrating a control system including a hardware configuration controlling an operation of a recording material determination apparatus, and a function thereof.

Next, the recording material determination apparatus 30 according to the present exemplary embodiment will be described with reference to FIG. 2. FIG. 2 is a block diagram illustrating a control system including a hardware configuration controlling an operation of the recording material determination apparatus 30, and a function thereof.

An ultrasonic wave transmission unit 31 transmits an ultrasonic wave to a recording material P. An ultrasonic wave reception unit 32 receives an ultrasonic wave transmitted through the recording material P. In the present exemplary embodiment, the ultrasonic wave transmission unit 31 and the ultrasonic wave reception unit 32 are set to transmit and receive an ultrasonic wave with a frequency of 40 kHz.

In addition, the frequency of the ultrasonic wave is determined in advance, and may be selected within a suitable range according to the detection accuracy and the configurations of the ultrasonic wave transmission unit 31 and the ultrasonic wave reception unit 32, and the present invention is not limited thereto.

A transmission control unit 33 serves as a transmission unit that has a function of generating a driving signal for transmission of an ultrasonic wave and amplifying the driving signal. A reception control unit 34 has a function of detecting an ultrasonic wave received by the ultrasonic wave reception unit 32 as a voltage, and processing the signal. These respective units and a control unit 10 constitute the recording material determination apparatus 30.

In addition, the determination result of the control unit 10 can be used to control, for example, a motor driving and image forming conditions such as a fixing conveyance speed, a fixing and adjusting temperature, and the like.

Next, an operation sequence will be described. A measurement start indication signal is input from the control unit 10 to a driving signal control unit 341. When receiving the input signal, the driving signal control unit 341 notifies a transmission signal generation unit 331 of generation of an ultrasonic wave transmission signal, in order to transmit an ultrasonic wave of a predetermined frequency.

In order to reduce the influence of a disturbance such as a reflection wave by a member around the conveyance path or the recording material P, so that the ultrasonic wave reception unit 32 can receive only a direct wave irradiated by the ultrasonic wave transmission unit 31, the driving signal of a pulse wave of a predetermined period is input. This is referred to as a burst wave.

In the present exemplary embodiment, a 40 kHz pulse wave of five continuous pulses is input every 20 ms. Also, simultaneously, a timer 345 is reset to start a counter. The transmission signal generation unit 331 generates and outputs a signal with a predetermined frequency. An amplifier 332 amplifies a signal level (voltage value) and outputs the result to the ultrasonic wave transmission unit 31.

The ultrasonic wave reception unit 32 receives an ultrasonic wave transmitted from the ultrasonic wave transmission unit 31, or an ultrasonic wave transmitted through the recording material P, and outputs the received ultrasonic wave to a detection circuit 342 of the reception control unit 34. The detection circuit 342 has a signal amplification function and a signal rectification function. In the present exemplary embodiment, the amplification function may be set to vary a gain in the state of the absence of the recording material P between the ultrasonic wave transmission unit 31 and the ultrasonic wave reception unit 32 and the state of the presence of the recording material P therebetween. However, the present invention is not limited thereto. For example, a gain in the state of the absence of the recording material P therebetween may be equal to a gain in the state of the presence of the recording material P therebetween.

Further, the rectification function performs half-wave rectification. However, it is not limited thereto. For example, the rectification function may perform full-wave rectification. A signal generated by the detection circuit 342 is converted by an A-D conversion unit 343 from an analog signal to a digital signal. In the present exemplary embodiment, the signal is converted into a 12-bit digital signal corresponding to an output of the detection circuit 342. However, it is not limited thereto, and the signal may be converted into an appropriate digital signal of a plurality of bits.

A peak extraction unit 344 extracts a signal peak (maximum value) based on the converted digital signal. The timer 345 is reset to start a count from the start of an ultrasonic wave driving signal. The peak extraction unit 344 sequentially performs a processing, and extracts a value of the timer 345 at the timing of peak detection. At the timing of completion of one measurement, the value extracted by the peak extraction unit 344 and the value extracted by the timer 345 is stored in a storage unit 346 in a paired manner.

A calculation unit 347 calculates a variation from a peak value obtained through multiple-time measurement. The control unit 10 determines the type of the recording material P based on the value calculated by the calculation unit 347, and controls an operation of the image forming apparatus 1 according to the determination result.

Figure 3A:
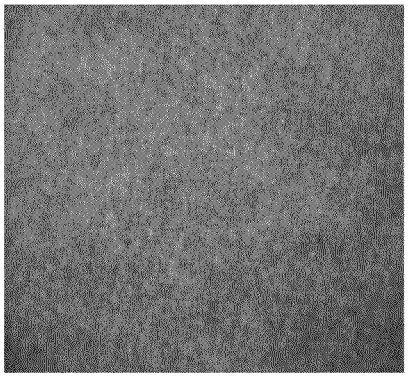
FIGS. 3A and 3B each illustrate a captured image of a surface of a recording material P.
Figure 3B:
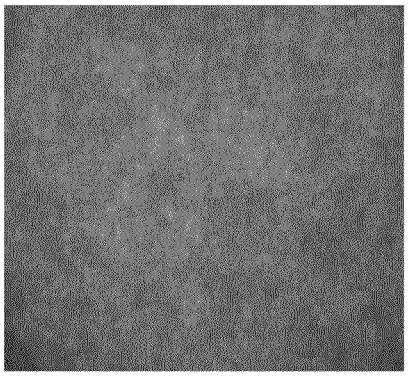

FIGS. 3A and 3B illustrate a captured image of a surface of a recording material P, which is captured while a rear side of the recording material P is irradiated with light. The recording material P used herein has a grammage of 60 g/m$^2$. In addition, although a recording material P with a grammage of 60 g/m$^2$ is used herein as an example, a surface property of a recording material P with any grammage can be determined.

FIG. 3A illustrates data for a recording material P having a rough surface (hereinafter, referred to as a bond paper). FIG. 3B illustrates data for a recording material P having a smoother surface than the bond paper (hereinafter, referred to as a plain paper).

First, a comparison between the bond paper and the plain paper will be described. An image size is a width of 365 mm and a height of 274 mm. It can be seen from FIG. 3A that the bond paper has a high contrast. On the other hand, it can be seen from FIG. 3B that the plain paper has a lower contrast than the bond paper.

The contrast is caused by the density unevenness or the thickness unevenness of the surface of the recording material P. It can be seen that when the recording material P has a rougher surface like the bond paper, the thickness unevenness and the density unevenness increase and the contrast increases.

Figure 4A:
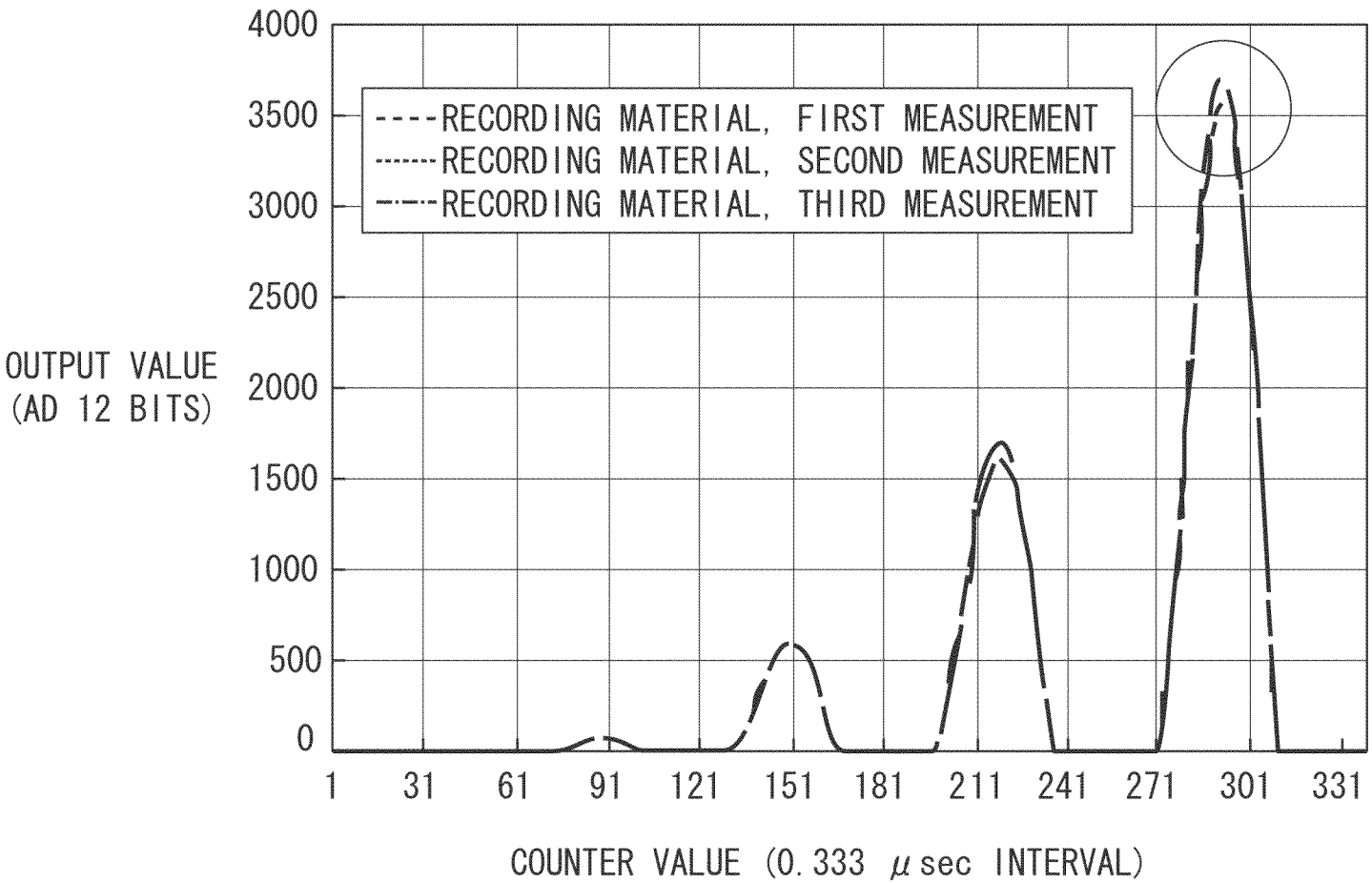
FIGS. 4A and 4B respectively illustrate a waveform of a reception signal of an ultrasonic wave received when a bond paper and a plain paper is irradiated with an ultrasonic wave.
Figure 4B:
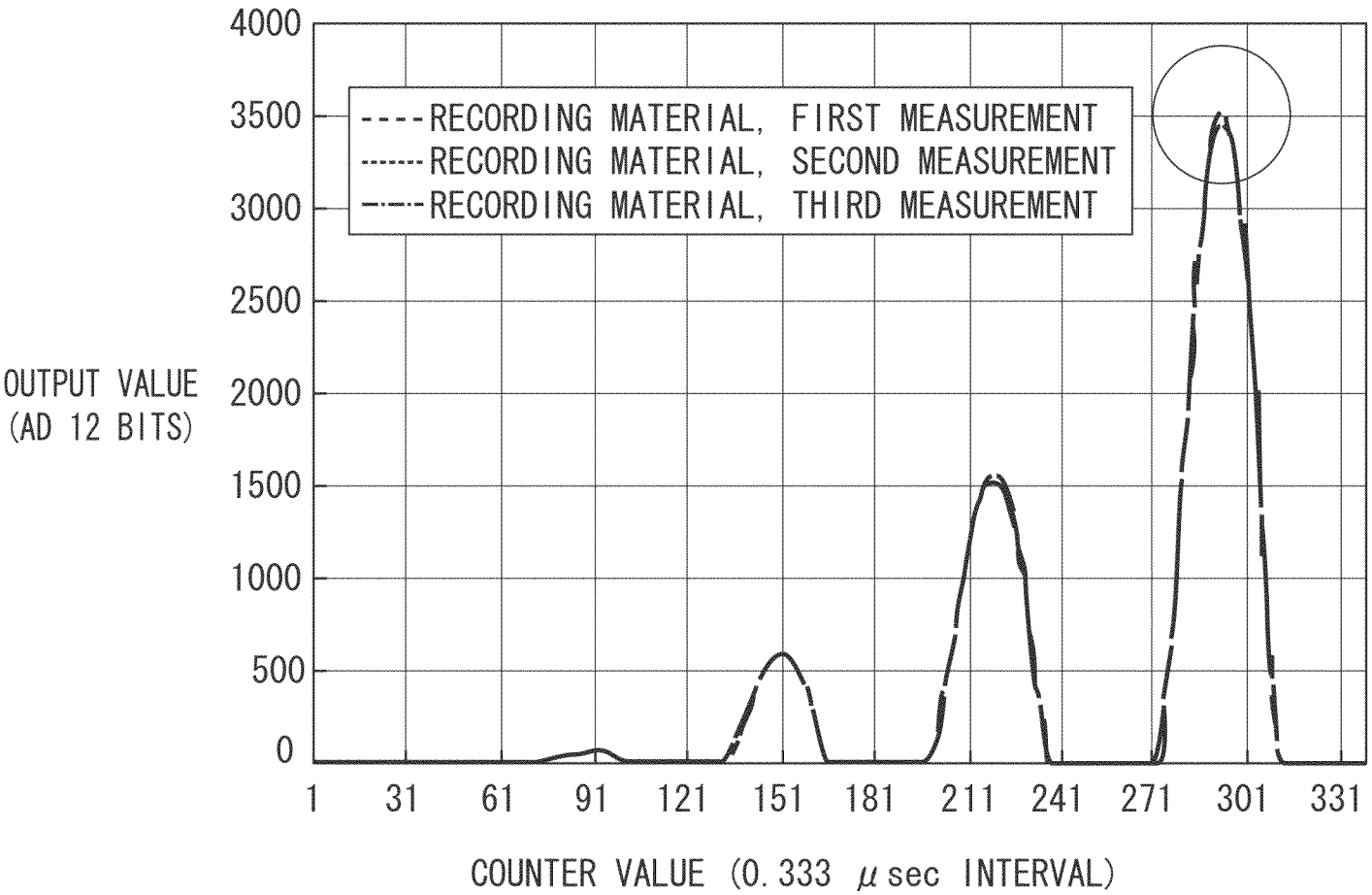

FIGS. 4A and 4B respectively illustrate a waveform of a reception signal of an ultrasonic wave received when a bond paper and a plain paper is irradiated with an ultrasonic wave. A recording material P used herein has a grammage of 60 g/m$^2$ as in FIG. 3. FIG. 4A illustrates data for the bond paper. FIG. 4B illustrates data for the plain paper. In the respective data, overlapped three measured waveforms are illustrated as a graph. A horizontal axis represents a counter value when the data is measured at intervals of 0.333 μsec. A vertical axis represents a value obtained by converting an output voltage by the A-D conversion unit 343.

In the case of the bond paper, it can be seen that a change in a peak value measured a plurality of times is large. In the case of the plain paper, it can be seen that a change in a peak value measured a plurality of times is small. The reason for this is that when different points of the recording material P are measured, the measurement results are different due to the degree of the surface unevenness of the recording material P. Particularly, in the case of the bond paper having a rough surface, since the surface unevenness is high, the measurement value greatly changes according to the measurement points.

In the case of the plain paper having a smoother surface than the bond paper, since the surface unevenness is lower than that of the bond paper, a variation in the measurement value depending on the measurement points is smaller than that of the bond paper. Due to this characteristic, the recording material P may be irradiated with an ultrasonic wave a plurality of times, an ultrasonic wave transmitted through the recording material P may be measured a plurality of times, and a surface property of the recording material P may be determined based on a variation in the respective measurement results.

Herein, an irradiation region of an ultrasonic wave is set to be 10 mm×10 mm as an example. The irradiation region may be preferably set to be 10 mm×10 mm or less, however, the present exemplary embodiment is not limited thereto. In addition, when detection is performed a plurality of times while the irradiation region is shifted by several mm, the measurement result can be obtained at high accuracy.

Figure 5A:
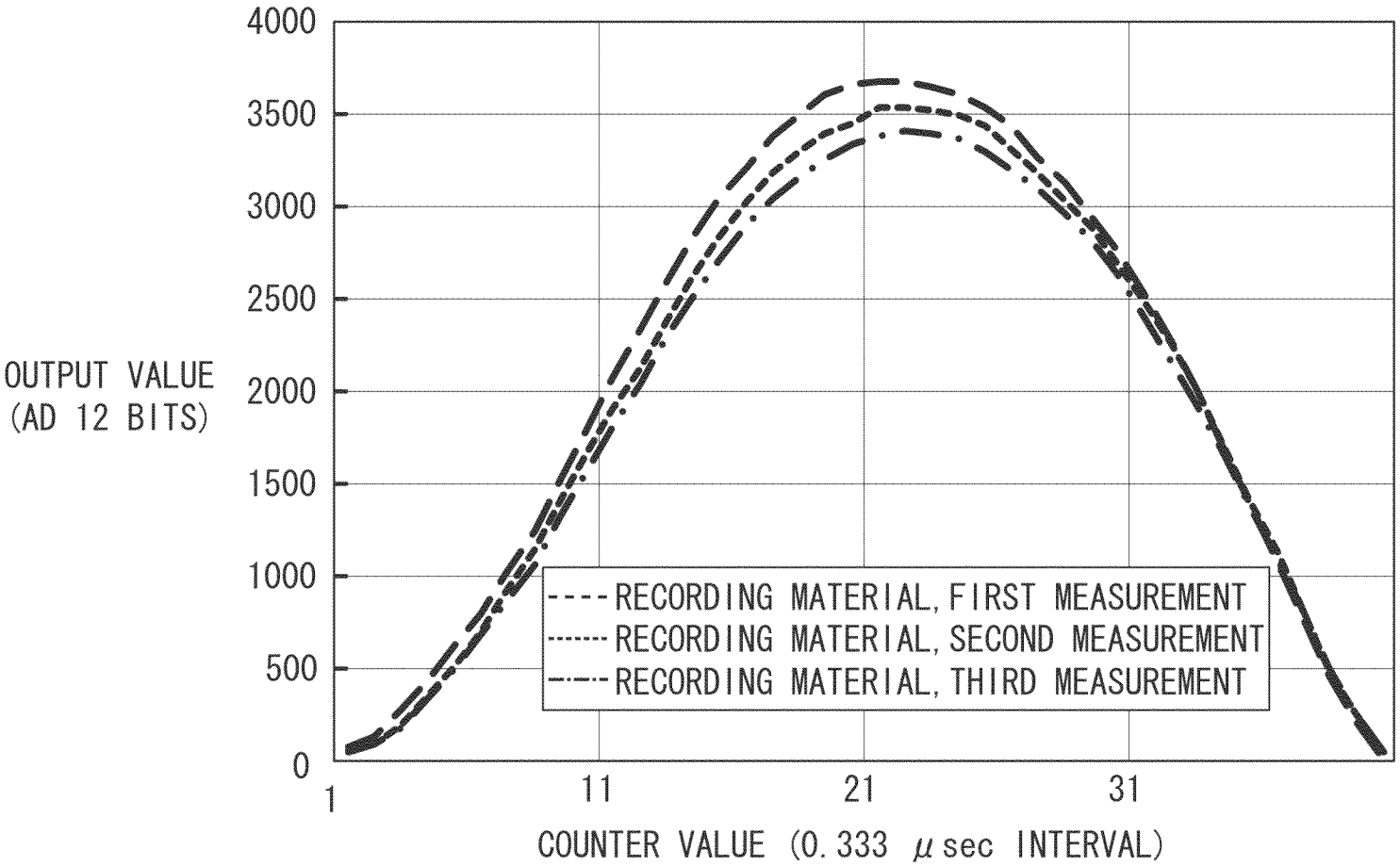
FIGS. 5A and 5B each illustrate an expanded waveform near a peak indicated by a circle of FIGS. 4A and 4B.
Figure 5B:
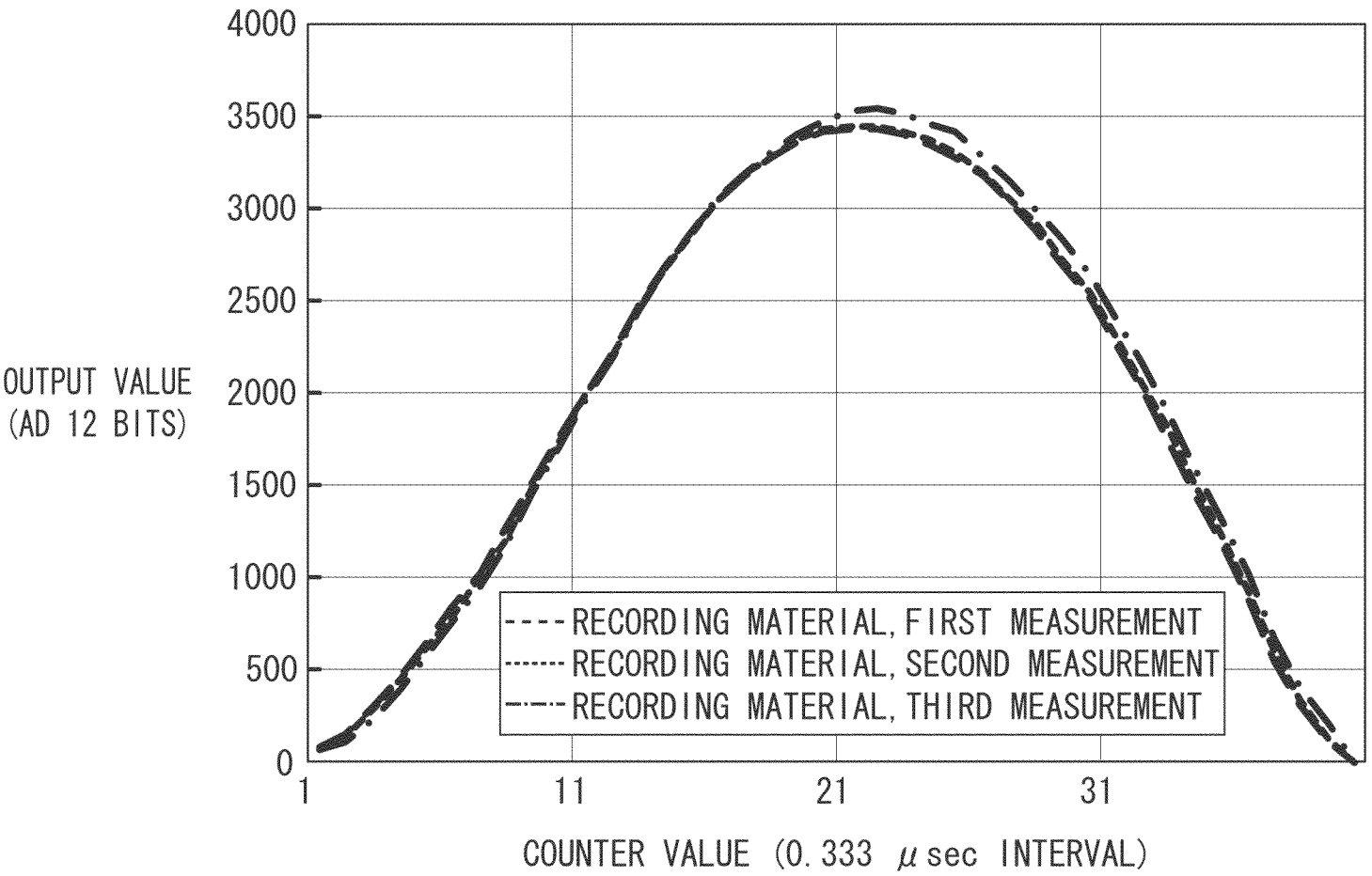

FIGS. 5A and 5B each illustrate an expanded waveform near a peak indicated by a circle of FIGS. 4A and 4B. As described above referring to FIGS. 4A and 4B, it can be seen that the bond paper has a large peak value change and the plain paper has a smaller peak value change than the bond paper. In addition, herein, although three-time measurement results are illustrated as an example, measurement may be performed more than three times.

Figure 6:
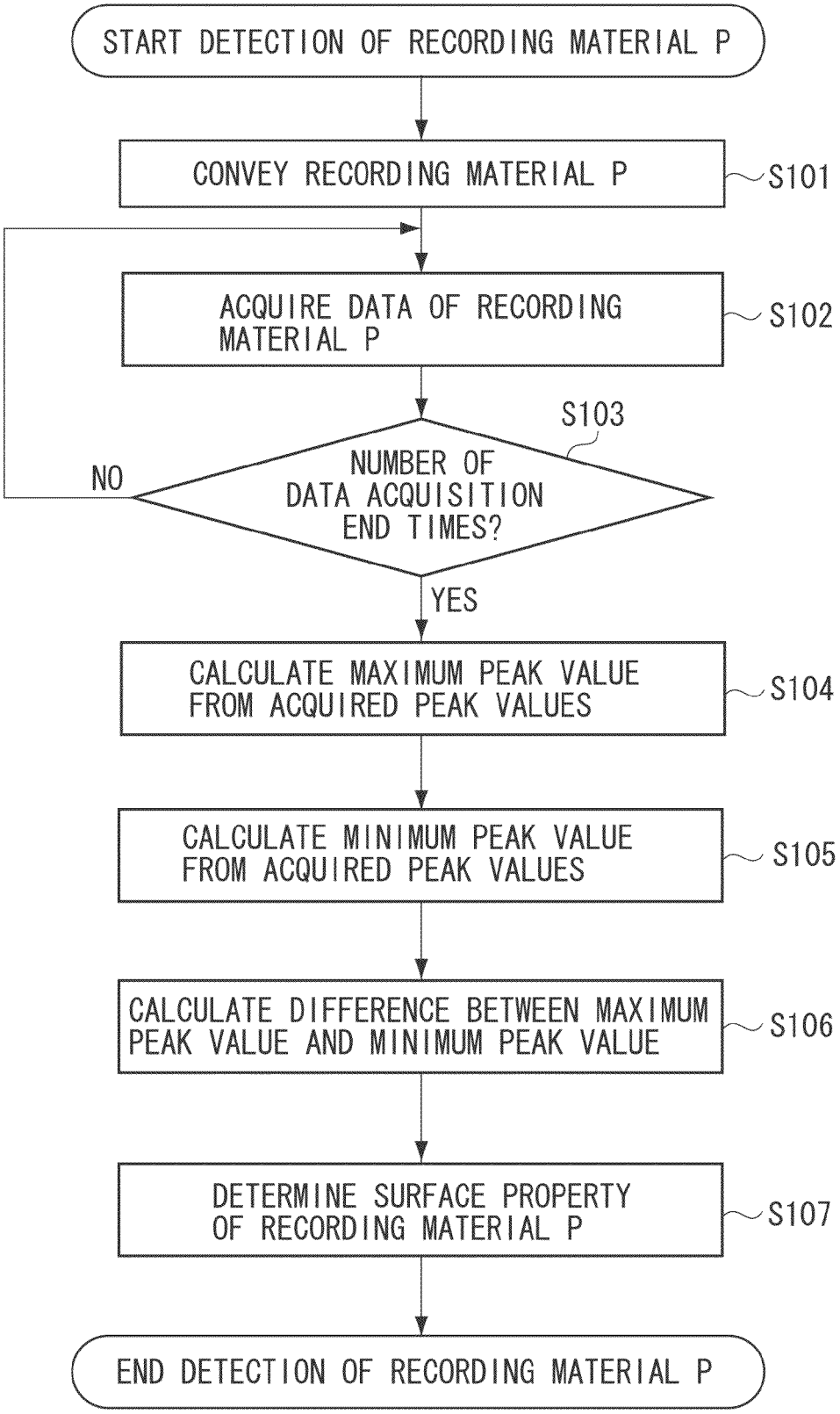
FIG. 6 is a flowchart illustrating a method for detecting a surface property of a recording material P based on a variation in a peak value of an ultrasonic wave.

FIG. 6 is a flowchart illustrating a method for detecting a surface property of a recording material P based on a variation in a peak value of an ultrasonic wave. In step S101, the control unit 10 conveys the recording material P to a position between the ultrasonic wave transmission unit 31 and the ultrasonic wave reception unit 32 of the recording material determination apparatus 30. In step S102, the control unit 10 irradiates the recording material P with an ultrasonic wave by using the ultrasonic wave transmission unit 31.

An ultrasonic wave transmitted through the recording material P is received by the ultrasonic wave reception unit 32. The control unit 10 measures a peak value of the received ultrasonic wave. The measurement result is stored in the storage unit 346.

In step S103, the control unit 10 determines whether a number of data acquisition times of the recording material P is a predetermined number of data acquisition end times. In order to determine a surface property of the recording material P, since a variation in the peak value needs to be calculated, data needs to be measured a plurality of times. If the number of data acquisition times does not reach the predetermined number of data acquisition end times (NO in step S103), the processing returns to step S102 to acquire data again.

In addition, in the present exemplary embodiment, the number of data acquisition end times is set to be 30 as an example. The number of data acquisition end times is the number of times by which the ultrasonic wave transmission unit 31 can transmit an ultrasonic wave a plurality of times and the ultrasonic wave reception unit 32 can receive an ultrasonic wave a plurality of times, while the recording material P is present between the ultrasonic wave transmission unit 31 and the ultrasonic wave reception unit 32. The upper limit of the number of the measurement times may be set suitably according to a conveyance speed of the recording material P and an acquisition time period of reception data of an ultrasonic wave.

If the number of data acquisition times reaches the predetermined number of data acquisition end times (YES in step S103), then in step S104, the control unit 10 calculates a maximum peak value based on a plurality of acquired peak values. In step S105, the control unit 10 calculates a minimum peak value based on the plurality of acquired peak values. In step S106, the control unit 10 calculates a difference between the maximum peak value calculated in step S104 and the minimum peak value calculated in step S105.

In step S107, the control unit 10 determines a surface property of the recording material P based on the peak value difference calculated in step S106. Meanwhile, the relationship between the peak value difference and the recording material P will be described below in detail.

Figure 7A:
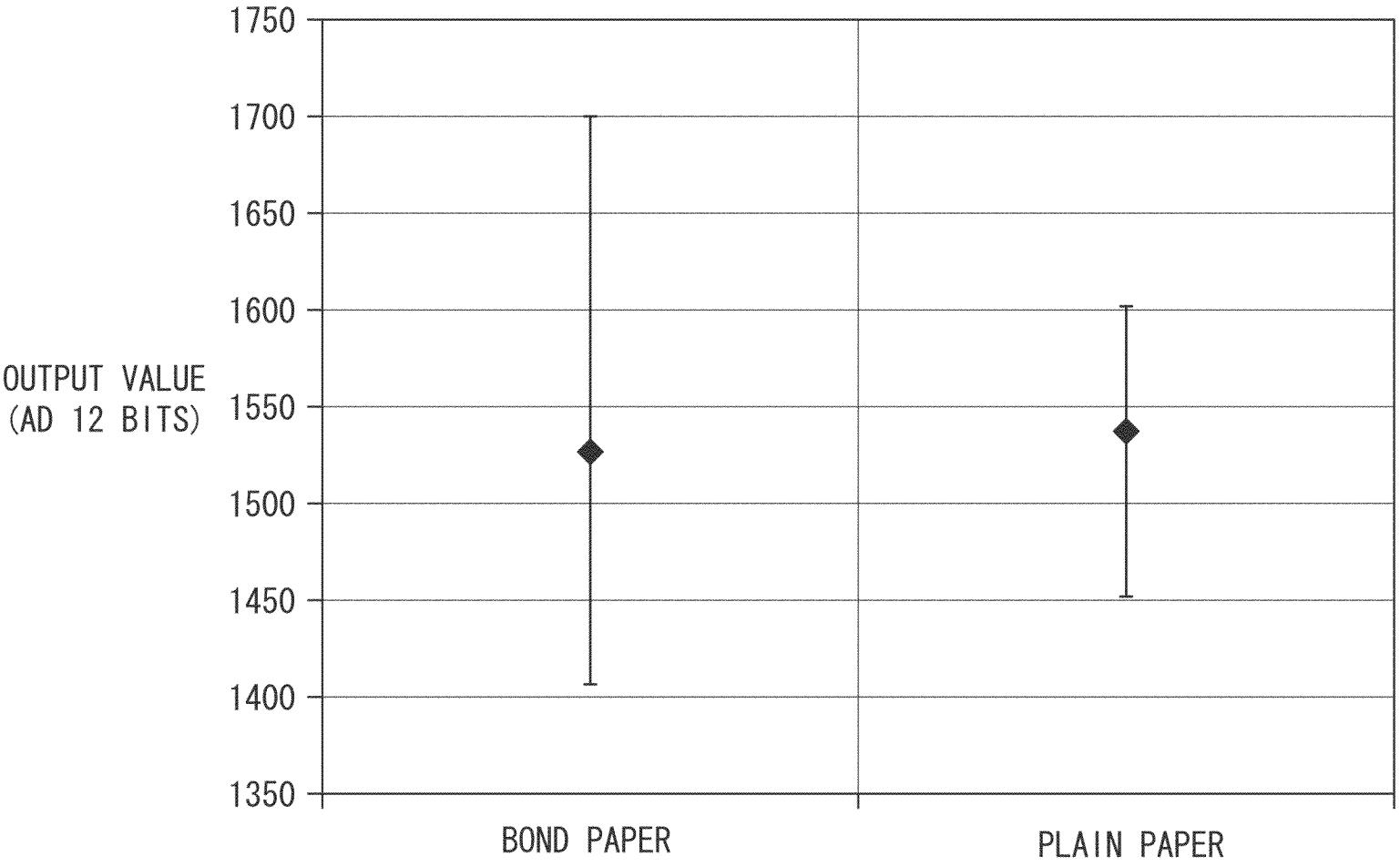
FIGS. 7A and 7B are graphs respectively illustrating an average value of peak values, a maximum value, and a minimum value of a peak value of an ultrasonic wave measured in a bond paper and a plain paper.
Figure 7B:
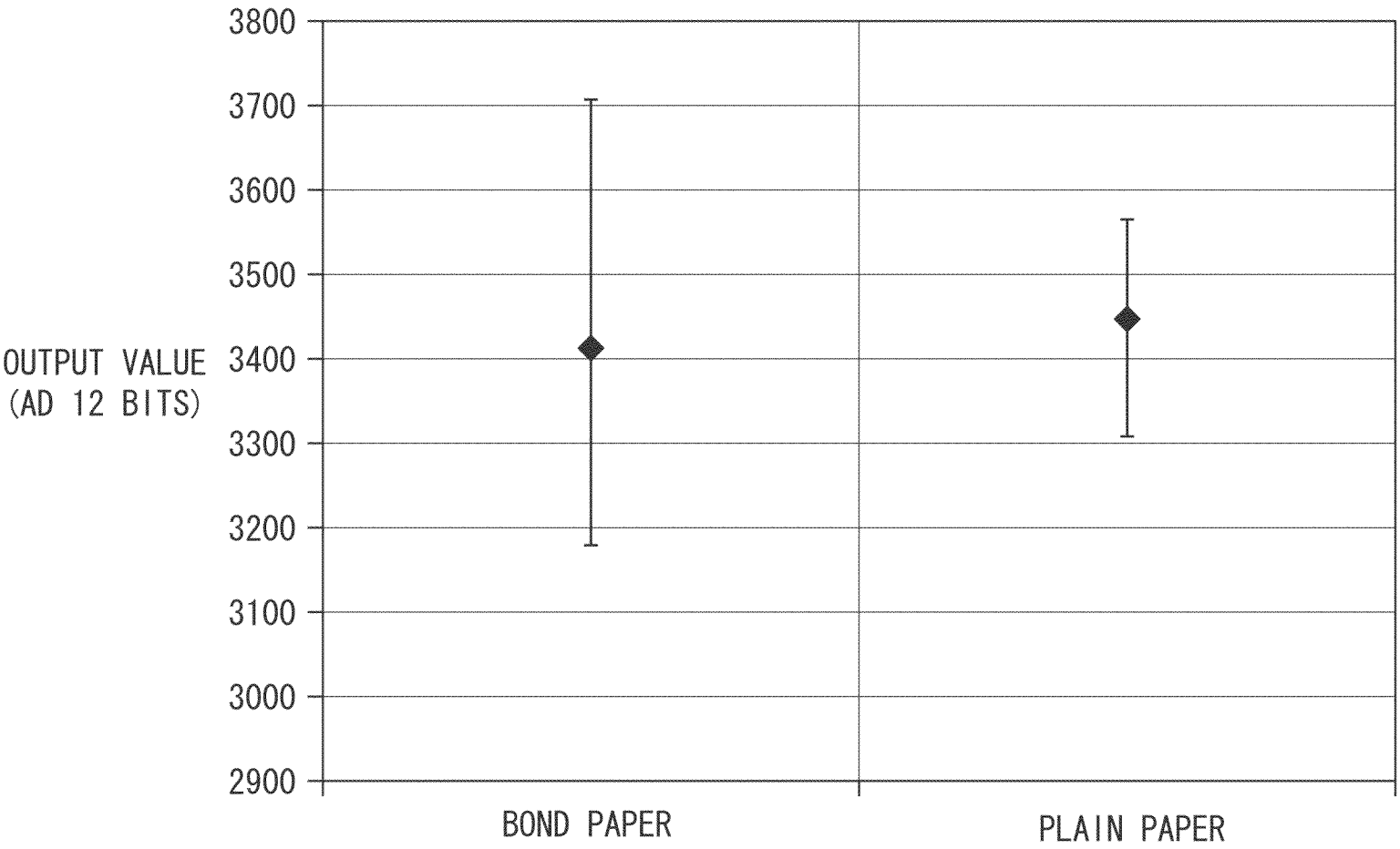

FIG. 7A is a graph illustrating an average value of peak values, a maximum value, and a minimum value of a peak value of an ultrasonic wave measured in a bond paper and a plain paper. FIG. 7B is a graph illustrating an average value of peak values, a maximum value, and a minimum value of a peak value of an ultrasonic wave measured when an output value is increased by increasing the wave number of an ultrasonic wave as compared to the case of FIG. 7A. A recording material used in FIGS. 7A and 7B has a grammage of 60 g/m$^2$. A vertical axis represents a value obtained by converting an output voltage by the A-D conversion unit 343.

A method for determining a surface property of a recording material P will be described with reference to FIGS. 7A and 7B. In FIG. 7A, in the case of the bond paper having a rough surface, a maximum peak value is 1700 and a minimum peak value is 1410. Herein, a determination is performed under the condition that a determination threshold value of the bond paper and the plain paper is 200.

In addition, the determination threshold value is an example in the present exemplary embodiment, and may be set suitably according to A-D conversion resolution or data acquisition timing. When the difference therebetween is calculated based on the flowchart illustrated in FIG. 6, the peak value difference is 290. When compared with the determination threshold value, since the peak value difference exceeds the determination threshold value, the recording material P can be determined to be the bond paper having a rough surface.

On the other hand, in the case of the plain paper having a smoother surface than the bond paper, the maximum peak value is 1600 and the minimum peak value is 1450. When the difference therebetween is e calculated based on the flowchart illustrated in FIG. 6, the peak value difference is 150. When compared with the determination threshold value, since the peak value difference does not exceed the determination threshold value, the recording material P can be determined to be the plain paper having a smoother surface than the bonding paper.

Herein, the method using the determination threshold value is described as an example. However, it is not limited thereto. For example, a table for determining a surface property of the recording material P may be prepared, and a determination can be made by comparing the peak value difference with the table.

Similarly, also in FIG. 7B, a surface property of the recording material P may be determined. In the case of the bond paper having a rough surface, the maximum peak value is 3710 and the minimum peak value is 3180. Herein, a determination is performed under the condition that a determination threshold value of the bond paper and the plain paper is 400. In addition, the determination threshold value is an example in the present exemplary embodiment, and can be set suitably according to A-D conversion resolution or data acquisition timing.

When the respective differences are calculated based on the flowchart illustrated in FIG. 6, the peak value difference is 530. When compared with the determination threshold value, since the peak value difference exceeds the determination threshold value, the recording material P can be determined to be the bond paper having a rough surface.

On the other hand, in the case of the plain paper having a smoother surface than the bond paper, the maximum peak value is 3570 and the minimum peak value is 3310. When the difference therebetween is calculated based on the flowchart illustrated in FIG. 6, the peak value difference is 260. When compared with the determination threshold value, since the peak value difference does not exceed the determination threshold value, the recording material P can be determined to be the plain paper having a smoother surface than the bond paper.

As described above, although the peak value is larger than that in FIG. 7A, a surface property of the recording material P can be determined by setting a suitable determination threshold value according to an output value of an ultrasonic wave. Therefore, when a sufficient output value is obtained, a surface property of the recording material P can be determined regardless of an output value difference caused by a difference in the wave number of an ultrasonic wave.

In the present exemplary embodiment, the method of calculating the maximum value and the minimum value from a plurality of peak values and calculating a variation thereof has been described. However, the method of determining the recording material P is not limited thereto. For example, instead of using the peak values, a standard deviation, a variance, or the like may be used to calculate a value for determining a surface property of the recording material P. A surface property of the recording material P can be similarly determined by using an integrated value of output values of a received ultrasonic wave and a variation of the integrated value.

Instead of calculating a difference between the maximum value and the minimum value of the output value, the maximum value, the minimum value, and a surface property of the recording material P may be associated in, for example, a table to determine the surface property.

As an example in the present exemplary embodiment, a description has been made under the condition that the number of times of measurement in FIGS. 7A and 7B is 30, however, the measurement method is not limited thereto. For example, the number of times of measurement may be set to 10, this may be repeated three times, and a surface property of the recording material P may be determined based on three derived results.

That is, as a specific example, if the first determination is the plain paper, the second determination is the bond paper, and the third determination is the plain paper, then the recording material P may be determined to be the plain paper that is detected two times. By performing such a control, a surface property of the recording material P can be determined with high accuracy, even when there is a variation greater than an original output value of the recording material P due to the influence of a disturbance, for example.

In this manner, the surface unevenness of the recording material P can be detected by measuring the output values of an ultrasonic wave at a plurality of different points in the recording material P. By calculating a variation in the peak values measured a plurality of times, the surface property of the recording material P can be detected with high accuracy in consideration of the unevenness of the recording material P.

In the first exemplary embodiment, the method for detecting a surface property difference between the bond paper and the plain paper has been described. In a second exemplary embodiment, a method for determining a surface property difference between the plain paper and a glossy paper that has a smoother surface than the plain paper will be described. A detailed description of the same configurations as those in the above described first exemplary embodiment will not be repeated herein.

Figure 8A:
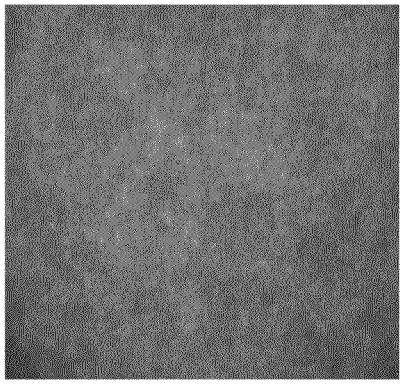
FIGS. 8A and 8B each illustrate a captured image of a surface of a recording material P.
Figure 8B:
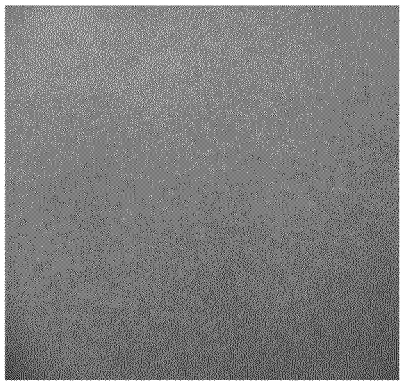

FIGS. 8A and 8B illustrate a captured image of a surface of a recording material P, which is captured while a rear side of the recording material P is irradiated with light. The recording material P used herein has a grammage of 120 g/m$^2$. Although a recording material P with a grammage of 120 g/m$^2$ is used herein as an example, a surface property of a recording material P with any grammage can be determined.

FIG. 8A illustrates data for the plain paper. FIG. 8B illustrates data for a recording material P having a smoother surface than the plain paper (hereinafter referred to as a glossy paper). A comparison between the plain paper and the gloss paper will be described. An image size is a width of 365 mm and a height of 274 mm. It can be seen from FIG. 8A that the plain paper has a lower contrast than the bond paper.

On the other hand, it can be seen from FIG. 8B that the gloss paper has a lower contrast than the plain paper. The contrast is caused by the density unevenness or the thickness unevenness of the surface of the recording material P. It can be seen that when the recording material P has a smoother surface like the gloss paper, the thickness unevenness and the density unevenness decrease and the contrast decreases.

Figure 9A:
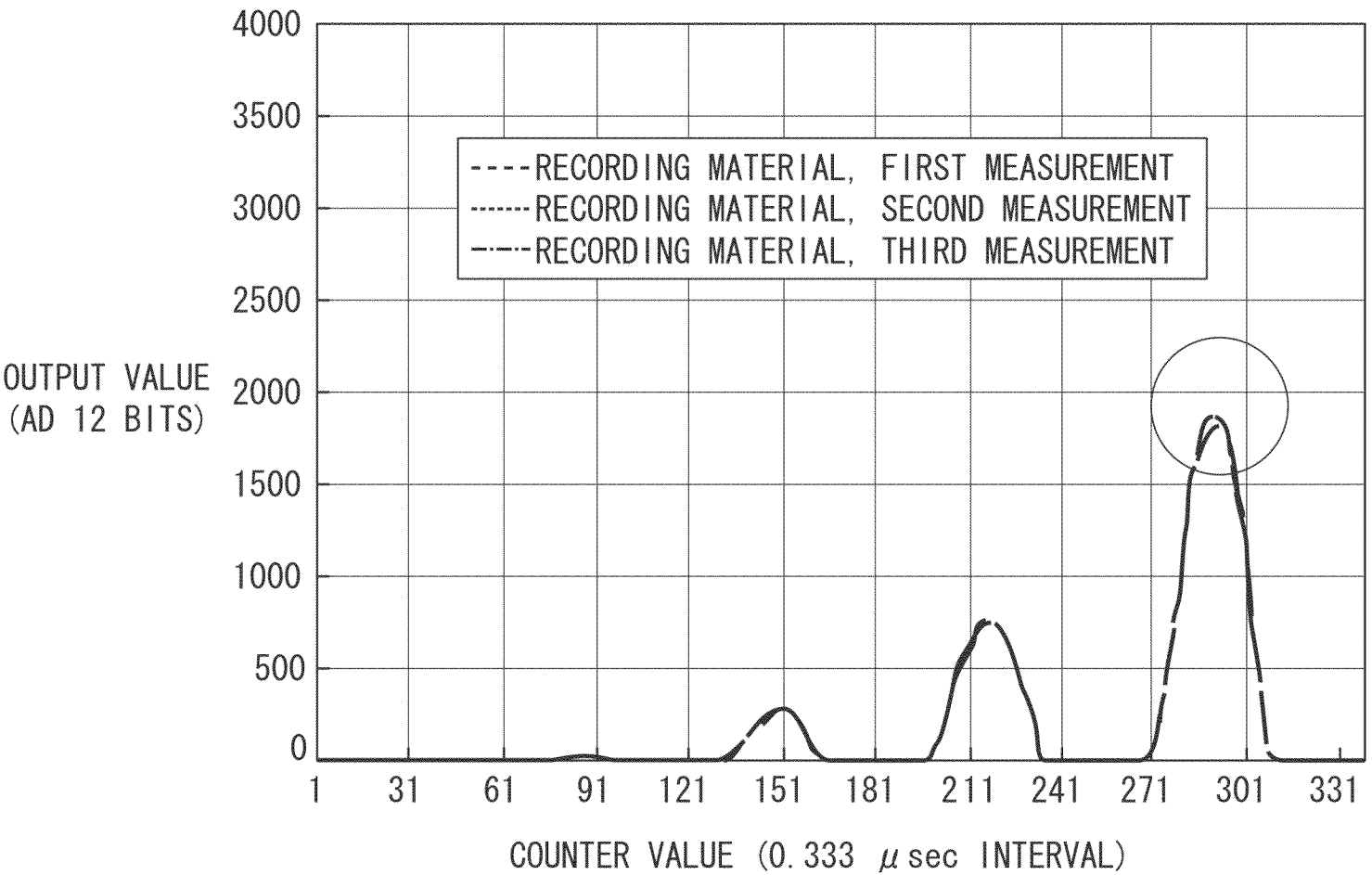
FIGS. 9A and 9B respectively illustrate a waveform of a reception signal of an ultrasonic wave received when a plain paper and a glossy paper is irradiated with an ultrasonic wave.
Figure 9B:
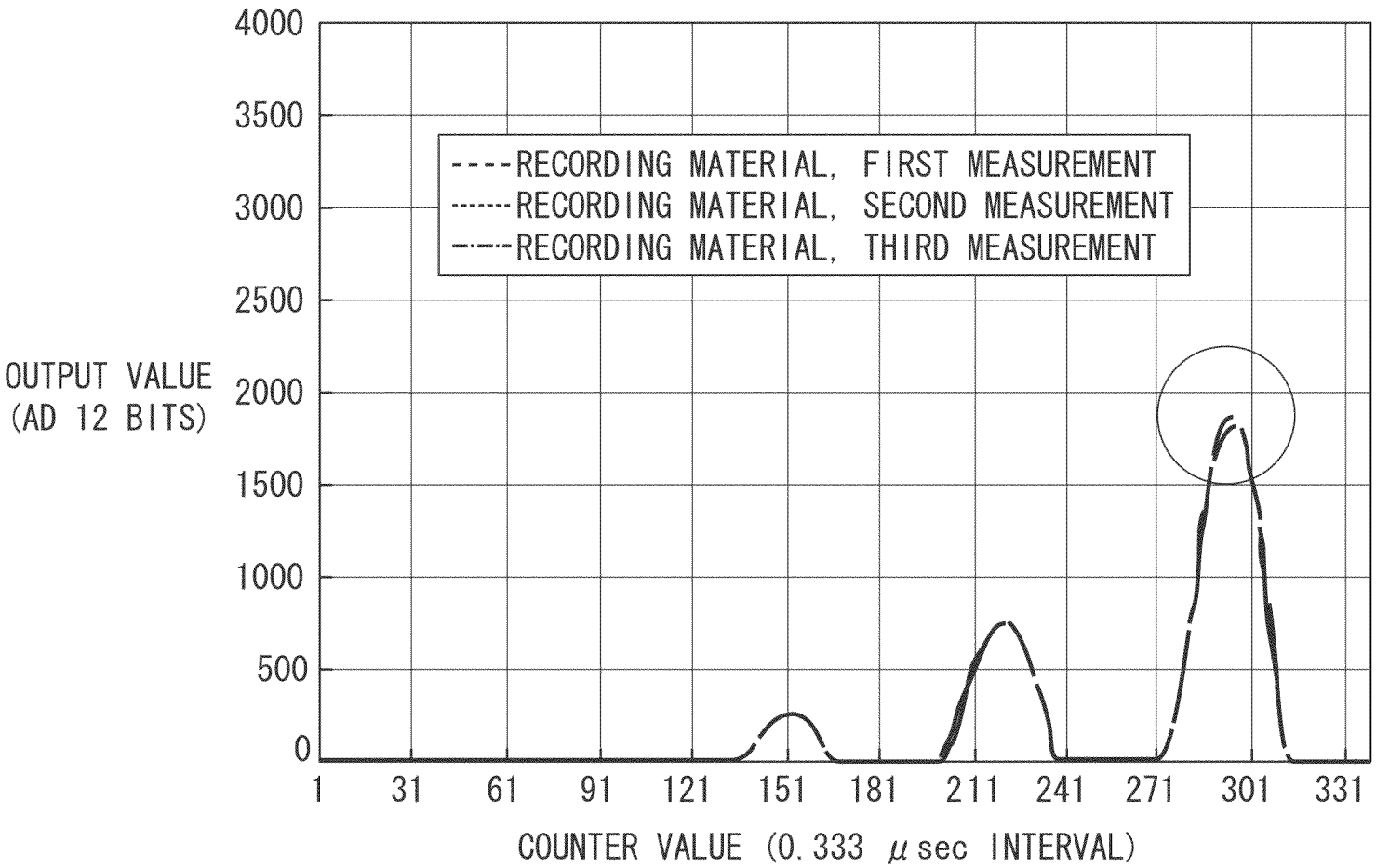

FIGS. 9A and 9B respectively illustrate a waveform of a reception signal of an ultrasonic wave received when a plain paper and a glossy paper is irradiated with an ultrasonic wave. As in FIGS. 8A and 8B, the recording material P used herein has a grammage of 120 g/m$^2$. FIG. 9A illustrates data for the plain paper. FIG. 9B illustrates data for the gloss paper. In the respective data, overlapped three measured waveforms are illustrated as a graph. A horizontal axis represents a counter value when the data is measured at intervals of 0.333 μsec. A vertical axis represents a value obtained by converting an output voltage by the A-D conversion unit 343.

In the case of the plain paper, it can be seen that a change in a peak value measured a plurality of times is small. In the case of the gloss paper, it can be seen that a change in a peak value measured a plurality of times is smaller than that of the plain paper. In the case of the gloss paper, a change in the peak value is very small. The reason for this is that when different points of the recording material P are measured, the measurement results are different due to the degree of the surface unevenness of the recording material P. Particularly, in the case of the gloss paper having a smooth surface, since the surface unevenness is low, a change in the measurement value is very small according to the measurement points.

Due to this characteristic, the recording material P may be irradiated with an ultrasonic wave a plurality of times, an ultrasonic wave transmitted through the recording material P may be measured a plurality of times, and a surface property of the recording material P can be determined based on a variation in the respective measurement results.

Herein, an irradiation region of an ultrasonic wave is set to be 10 mm×10 mm. The irradiation region may be preferably set to be 10 mm×10 mm or less, however, the present invention is not limited thereto. In addition, when detection is performed a plurality of times while the irradiation region is shifted by several mm, the measurement result can be obtained with high accuracy.

Figure 10A:
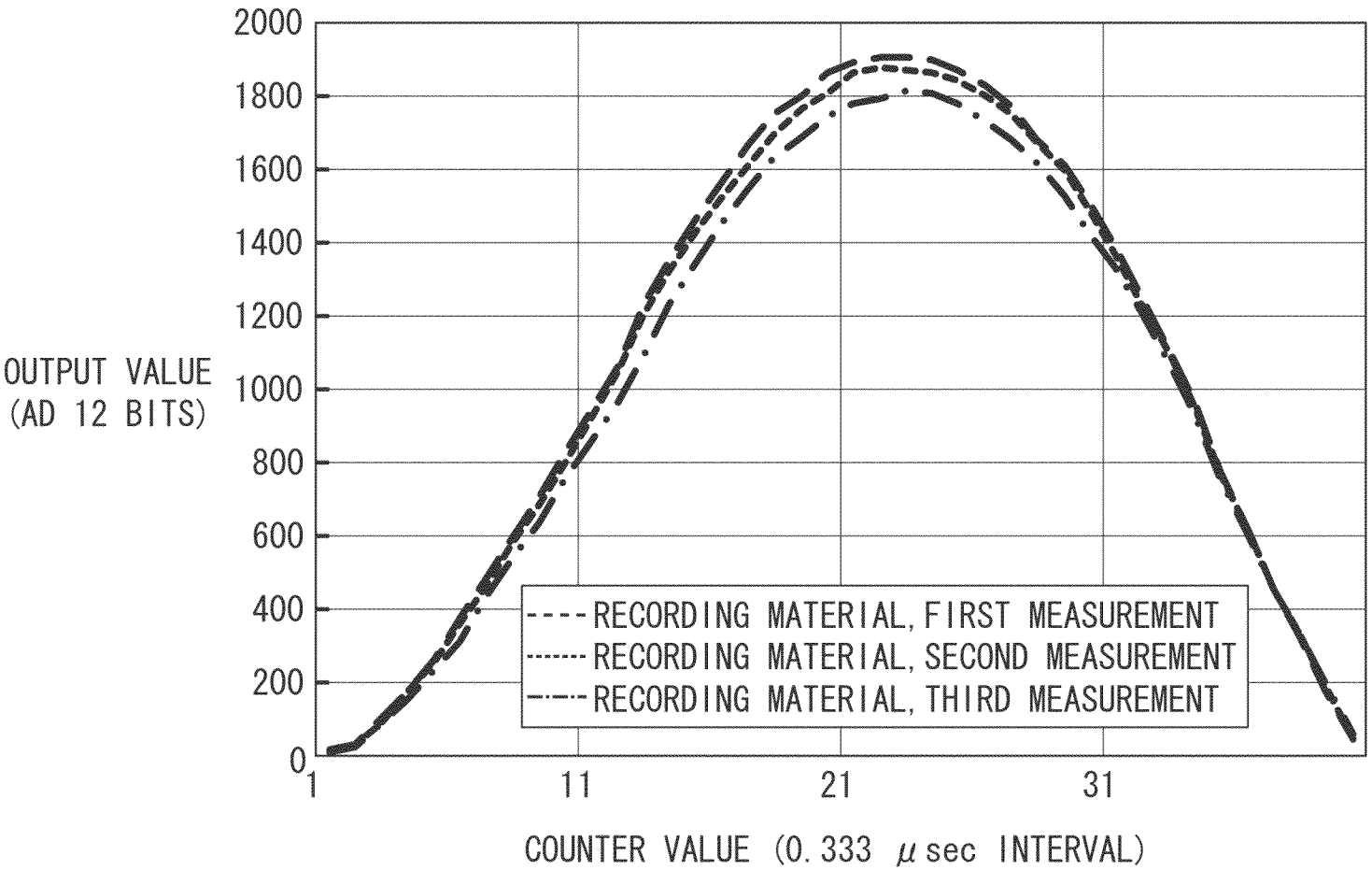
FIGS. 10A and 10B each illustrate an expanded waveform near a peak indicated by a circle of FIGS. 9A and 9B.
Figure 10B:
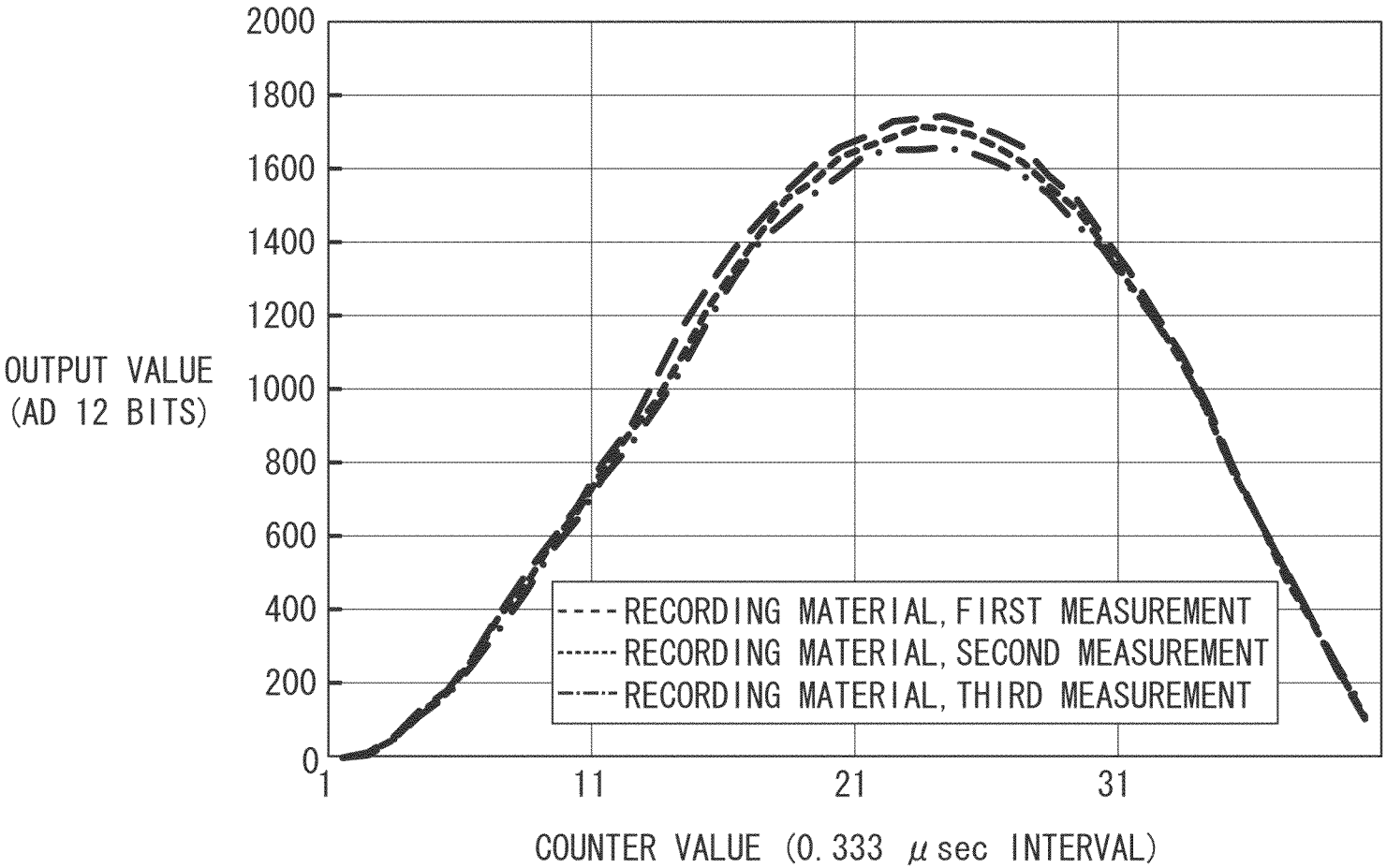

FIGS. 10A and 10B each illustrate an expanded waveform near a peak indicated by a circle of FIGS. 9A and 9B. As described above referring to FIGS. 9A and 9B, it can be seen that the plain paper has a small peak value change and the gloss paper has a smaller peak value change than the plain paper. In addition, herein, although three-time measurement results are illustrated as an example, measurement may be performed more than three times.

Since a method for calculating a difference between the peak values of an ultrasonic wave is the same as that described referring to the flow chart of FIG. 7, a description thereof will not be repeated herein.

Figure 11A:
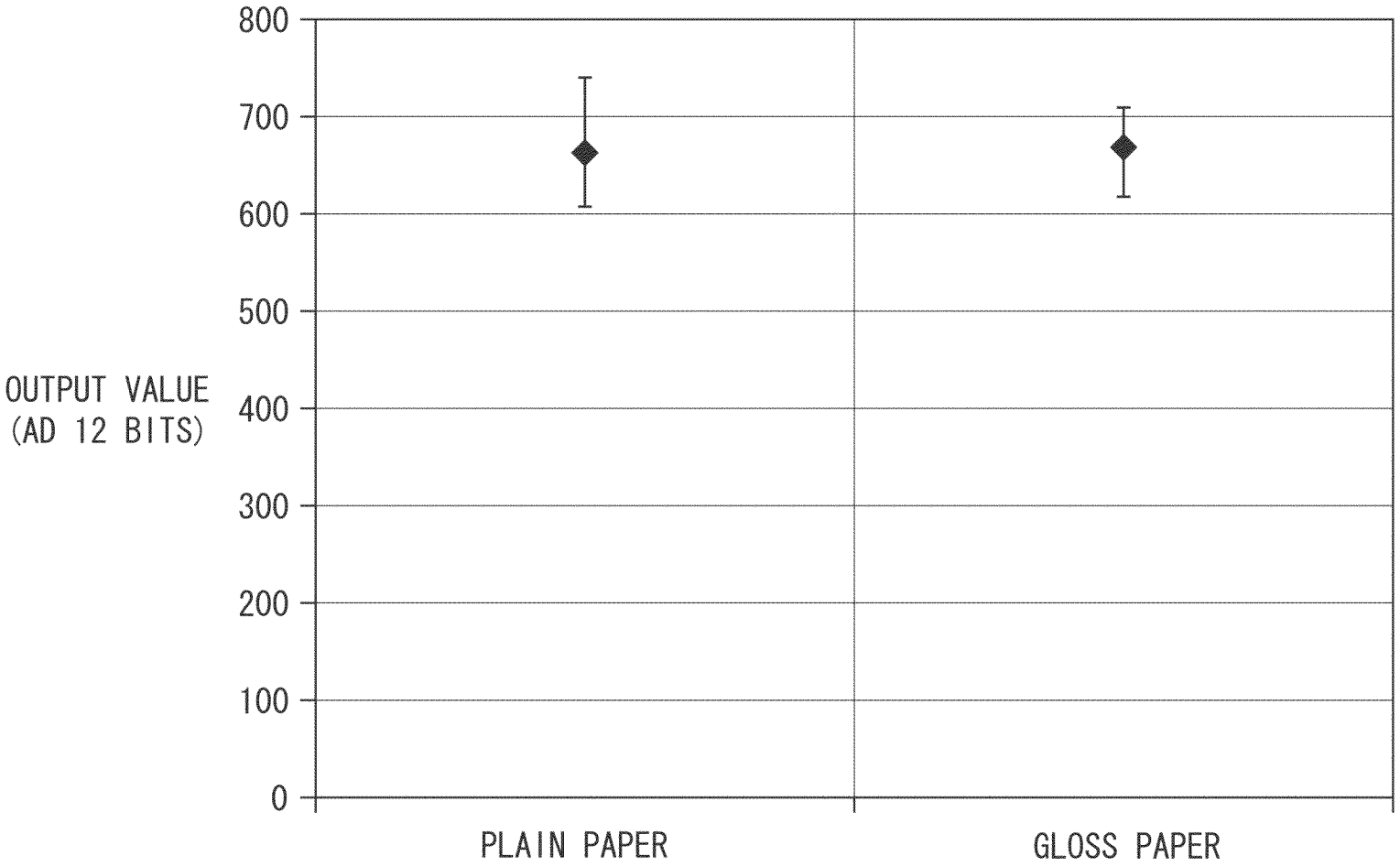
FIGS. 11A and 11B are graphs respectively illustrating an average value of peak values, a maximum value, and a minimum value of a peak value of an ultrasonic wave measured in a plain paper and a glossy paper.
Figure 11B:
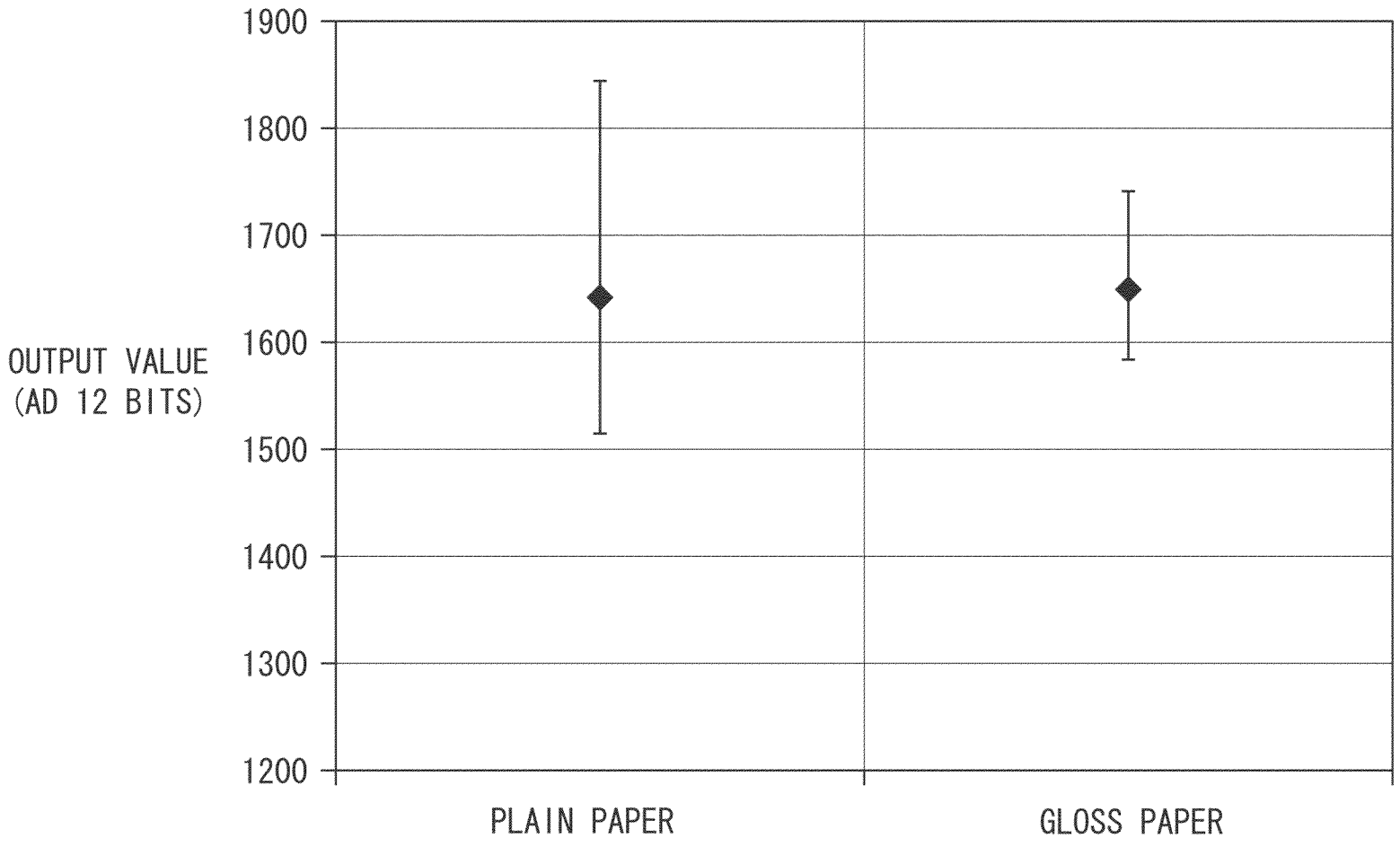

FIG. 11A is a graph illustrating an average value of peak values, a maximum value, and a minimum value of a peak value of an ultrasonic wave measured in a plain paper and a glossy paper. FIG. 11B is a graph illustrating an average value of peak values, a maximum value, and a minimum value of a peak value of an ultrasonic wave measured when an output value is increased by increasing the wave number of an ultrasonic wave as compared to the case of FIG. 11A. A recording material used in FIGS. 11A and 11B has a grammage of 120 $g/m^2$. A vertical axis represents a value obtained by converting an output voltage by the A-D conversion unit 343.

A method for determining a surface property of a recording material P will be described with reference to FIGS. 11A and 11B. In FIG. 11A, in the case of the plain paper, a maximum peak value is 745 and a minimum peak value is 610. Herein, a determination is performed under the condition that a determination threshold value of the plain paper and the gloss paper is 100. The determination threshold value is an example in the present exemplary embodiment, and may be set suitably according to A-D conversion resolution or data acquisition timing.

When the respective differences are calculated based on the flow chart illustrated in FIG. 6, the peak value difference is 135. When compared with the determination threshold value, since the peak value difference exceeds the determination threshold value, the recording material P may be determined to be the plain paper.

On the other hand, in the case of the gloss paper having a smoother surface than the plain paper, the maximum peak value is 705 and the minimum peak value is 620. When the respective differences are calculated based on the flow chart illustrated in FIG. 6, the peak value difference is 85. When compared with the determination threshold value, since the peak value difference does not exceed the determination threshold value, the recording material P may be determined to be the gloss paper having a smoother surface than the plain paper.

Similarly, also in FIG. 11B, a surface property of the recording material P can be determined. In the case of the plain paper, the maximum peak value is 1850 and the minimum peak value is 1510. Herein, a determination is performed under the condition that a determination threshold value of the bond paper and the plain paper is 200. In addition, the determination threshold value is an example in the present exemplary embodiment, and may be set suitably according to A-D conversion resolution or data acquisition timing.

When the respective differences are calculated based on the flow chart illustrated in FIG. 6, the peak value difference is 340. When compared with the determination threshold value, since the peak value difference exceeds the determination threshold value, the recording material P can be determined to be the plain paper. On the other hand, in the case of the gloss paper having a smoother surface than the plain paper, the maximum peak value is 1750 and the minimum peak value is 1590.

When the respective differences are calculated based on the flow chart illustrated in FIG. 6, the peak value difference is 160. When compared with the determination threshold value, since the peak value difference does not exceed the determination threshold value, the recording material P may be determined to be the gloss paper having a smoother surface than the plain paper.

In this manner, although the peak value is larger than that in FIG. 11A, a surface property of the recording material P can be determined by setting a suitable determination threshold value according to an output value of an ultrasonic wave. Therefore, when a sufficient output value is obtained, a surface property of the recording material P can be determined regardless of an output value difference caused by a difference in the wave number of an ultrasonic wave.

In addition, in the present exemplary embodiment, the method of calculating the maximum value and the minimum value from a plurality of peak values and calculating a variation thereof has been described. However, the method of determining the recording material P is not limited thereto. For example, instead of using the peak values, a standard deviation, a variance, or the like can be used as a value for determining a surface property of the recording material P. A surface property of the recording material P can be similarly determined by using an integrated value of the output values of a received ultrasonic wave and a variation of the integrated value.

Instead of calculating a difference between the maximum value and the minimum value of the output values, the maximum value, the minimum value, and a surface property of the recording material P can be associated in, for example, a table to determine the surface property.

In this manner, the surface unevenness of the recording material P can be detected by measuring the output values of an ultrasonic wave at a plurality of points in the recording material P. By calculating a variation in the peak value measured a plurality of times, the surface property of the recording material P can be detected with high accuracy in consideration of the unevenness of the recording material P.

In the first and second exemplary embodiments, a method for determining a surface property of a recording material P based on a variation in the peak value of an ultrasonic wave transmitted through the recording material P has been described. Ina third exemplary embodiment, a description will be given of a method for detecting a surface property of a recording material P based on a variation between a peak value of an ultrasonic wave received when the recording material P is not present between the ultrasonic wave transmission unit 31 and the ultrasonic wave reception unit 32, and a peak value of an ultrasonic wave transmitted through the recording material P. In addition, a detailed description of the similar configurations (such as the recording material determination apparatus) as in the above first or second exemplary embodiment will not be repeated herein.

Figure 12A:
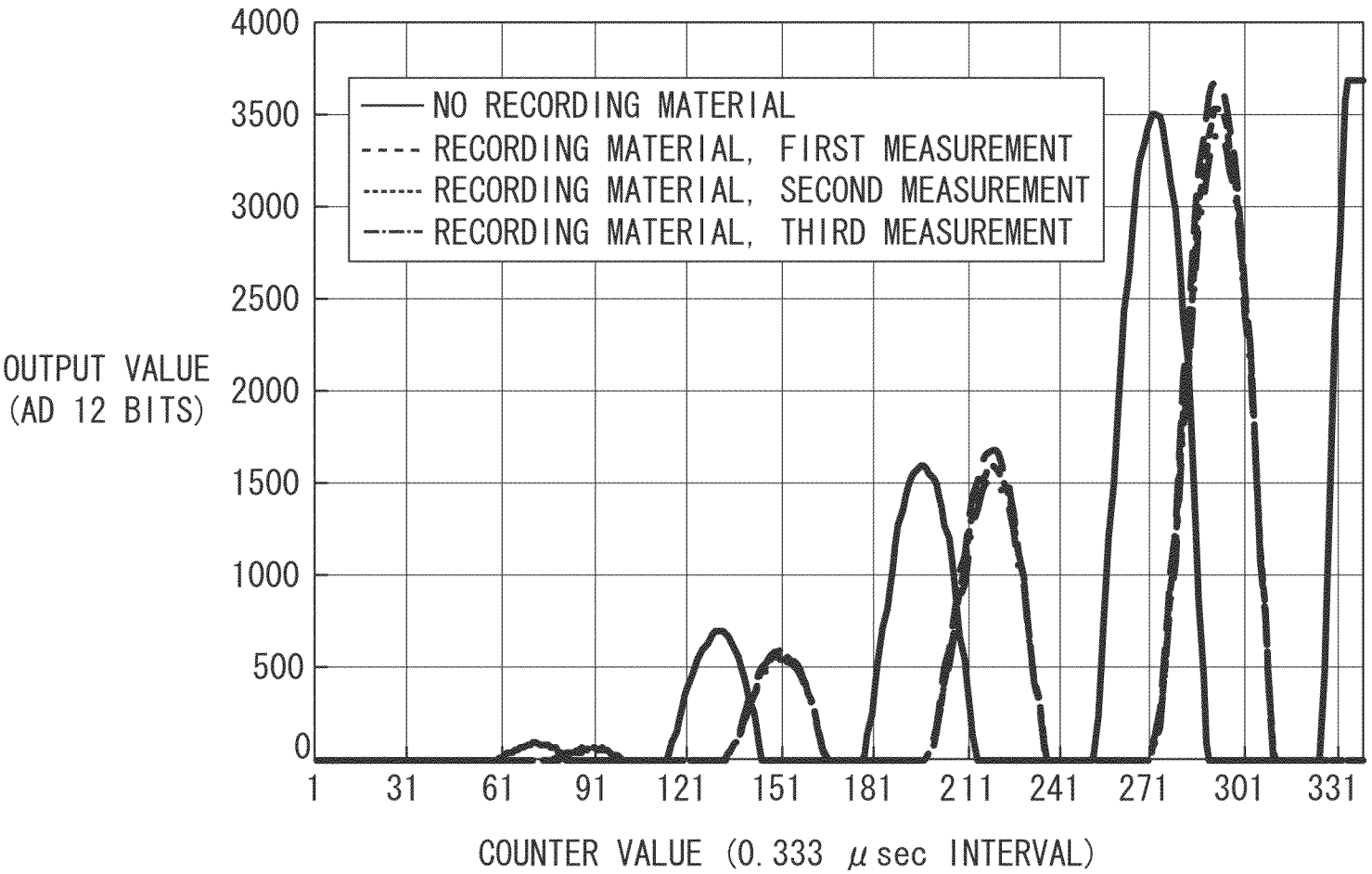
FIGS. 12A and 12B respectively illustrate a waveform of a reception signal of an ultrasonic wave received when a bond paper and a plain paper is irradiated with an ultrasonic wave.
Figure 12B:
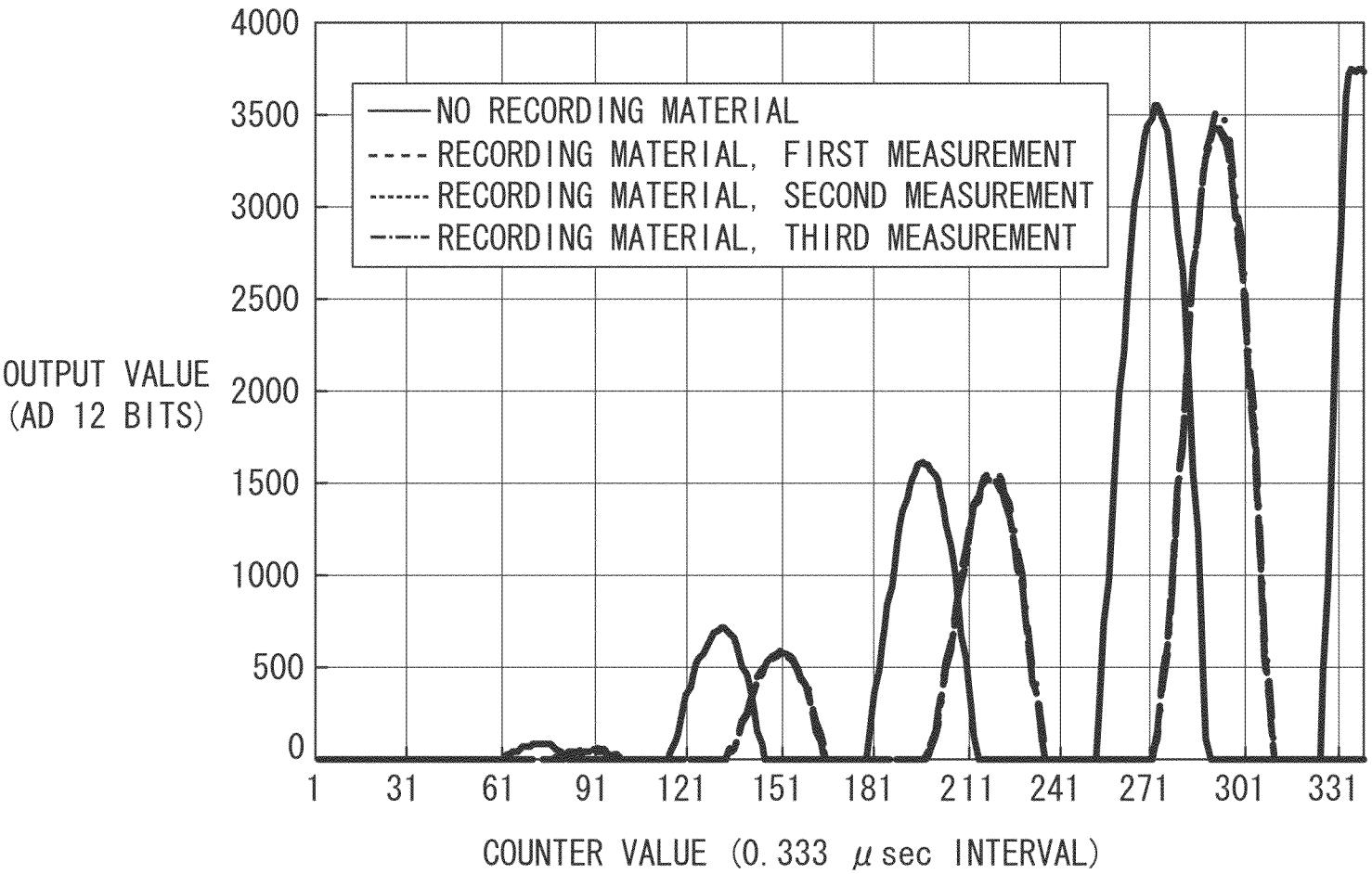

FIGS. 12A and 12B respectively illustrate a waveform of a reception signal of an ultrasonic wave received when a bond paper and a plain paper is irradiated with an ultrasonic wave. FIGS. 12A and 12B respectively illustrate a waveform of a reception signal of an ultrasonic wave when the recording material P is not present between the ultrasonic wave transmission unit 31 and the ultrasonic wave reception unit 32, and a waveform of a reception signal of an ultrasonic wave transmitted through the recording material P.

FIG. 12A illustrates data for the bond paper. FIG. 12B illustrates data for the plain paper. In the respective data, three-time measured waveforms are illustrated as a graph in an overlapping manner. A horizontal axis represents a counter value when the data is measured at intervals of 0.333 μsec. A vertical axis represents a value obtained by converting an output voltage by the A-D conversion unit 343.

In the case of the bond paper, when a ratio between a peak value measured when the recording material P is not present between the ultrasonic wave transmission unit 31 and the ultrasonic wave reception unit 32, and a measured peak value of an ultrasonic wave transmitted through the recording material P, is calculated, it can be seen that a variation therein is large.

In the case of the plain paper, when a ratio between a peak value measured when the recording material P is not present between the ultrasonic wave transmission unit 31 and the ultrasonic wave reception unit 32, and a measured peak value of an ultrasonic wave transmitted through the recording material P, is calculated, it can be seen that a variation therein is small.

The reason for this is that when different points of the recording material P are measured, the measurement results are different caused by the degree of the surface unevenness of the recording material P. Particularly, in the case of the bond paper having a rough surface, since the surface unevenness is high, the measurement value greatly changes according to the measurement points. In the case of the plain paper having a smoother surface than the bond paper, since the surface unevenness is lower than that of the bond paper, a variation in the measurement value depending on the measurement points is smaller than that of the bond paper.

With this characteristic, the recording material P may be irradiated with an ultrasonic wave a plurality of times, an ultrasonic wave transmitted through the recording material P may be measured a plurality of times, and a type of the recording material P can be determined based on a variation in the respective measurement results.

Figure 13:
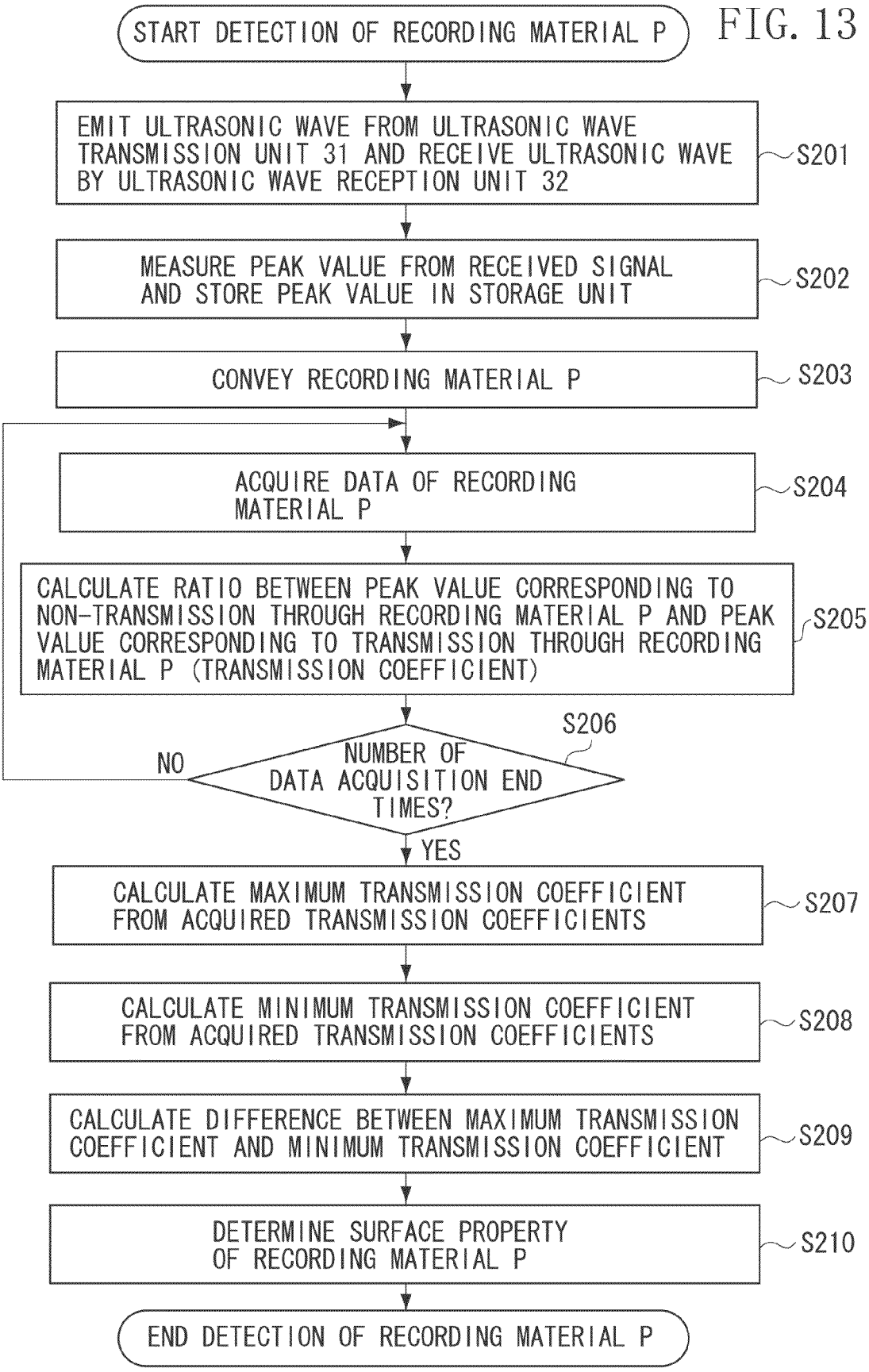
FIG. 13 is a flowchart illustrating a method for detecting a surface property of a recording material P based on a peak value measured when the recording material P is not present between an ultrasonic wave transmission unit 31 and an ultrasonic wave reception unit 32, and a variation in a measured peak value of an ultrasonic wave transmitted through the recording material P.

FIG. 13 is a flow chart illustrating a method for detecting a surface property of a recording material P based on a variation between a peak value measured when the recording material P is not present between the ultrasonic wave transmission unit 31 and the ultrasonic wave reception unit 32, and a measured peak value of an ultrasonic wave transmitted through the recording material P.

In step S201, the control unit 10 emits an ultrasonic wave by the ultrasonic wave transmission unit 31 when the recording material P is not present between the ultrasonic wave transmission unit 31 and the ultrasonic wave reception unit 32, and an ultrasonic wave is received by the ultrasonic wave reception unit 32. In step S202, the control unit 10 measures a peak value of the received ultrasonic wave. The measurement result is stored in the storage unit 346.

In step S203, the control unit 10 conveys the recording material P to a position between the ultrasonic wave transmission unit 31 and the ultrasonic wave reception unit 32 of the recording material determination apparatus 30.

In step S204, the control unit 10 emits an ultrasonic wave to the recording material P by using the ultrasonic wave transmission unit 31. An ultrasonic wave transmitted through the recording material P is received by the ultrasonic wave reception unit 32. The control unit 10 measures a peak value of the received ultrasonic wave. The measurement result is stored in the storage unit 346. In step S205, the control unit 10 calculates a ratio between the peak value of an ultrasonic wave, which is obtained in step S202 when the ultrasonic wave is not transmitted through the recording material P, and the peak value of an ultrasonic wave, which is obtained in step S204 when the ultrasonic wave is transmitted through the recording material P, as a transmission coefficient.

In step S206, the control unit 10 determines whether a number of data acquisition times the recording material P is a predetermined number of data acquisition end times. In order to determine the type of the recording material P, since a variation in the transmission coefficient needs to be calculated, data needs to be measured a plurality of times. If the number of data acquisition times does not reach the predetermined number of data acquisition end times (NO in step S206), the processing returns to step S204 to acquire data again.

In addition, in the present exemplary embodiment, the number of data acquisition end times is set to be 30 as an example. The number of data acquisition end times is the number of times by which the ultrasonic wave transmission unit 31 can transmit an ultrasonic wave a plurality of times and the ultrasonic wave reception unit 32 can receive the ultrasonic wave a plurality of times, while the recording material P is present between the ultrasonic wave transmission unit 31 and the ultrasonic wave reception unit 32. The upper limit of the number of measurement times may be set suitably according to a conveyance speed of the recording material P and an acquisition time period for receiving data of an ultrasonic wave.

If the number of data acquisition times reaches the number of predetermined data acquisition end times (YES in step S206), then in step S207, the control unit 10 calculates a maximum transmission coefficient based on a plurality of calculated transmission coefficients. In step S208, the control unit 10 calculates a minimum transmission coefficient based on the plurality of calculated transmission coefficients. In step S209, the control unit 10 calculates a difference between the maximum transmission coefficient calculated in step S207 and the minimum transmission coefficient calculated in step S208.

In step S210, the control unit 10 determines a surface property of the recording material P based on the transmission coefficient difference calculated in step S209. Accordingly, a surface property of the recording material P can be determined in the similar manner as in the first exemplary embodiment.

In addition, in the present exemplary embodiment, a method for calculating the maximum transmission coefficient and the minimum transmission coefficient from a plurality of acquired peak values is proposed as a method for calculating a variation in the output value; however, the present invention is not limited thereto.

For example, instead of using the peak values, a standard deviation, a variance, or the like can be used to calculate a value for determining a surface property of the recording material P. A surface property of the recording material P can be similarly determined by using an integrated value of output values of a received ultrasonic wave and a variation of the integrated value.

Figure 14A:
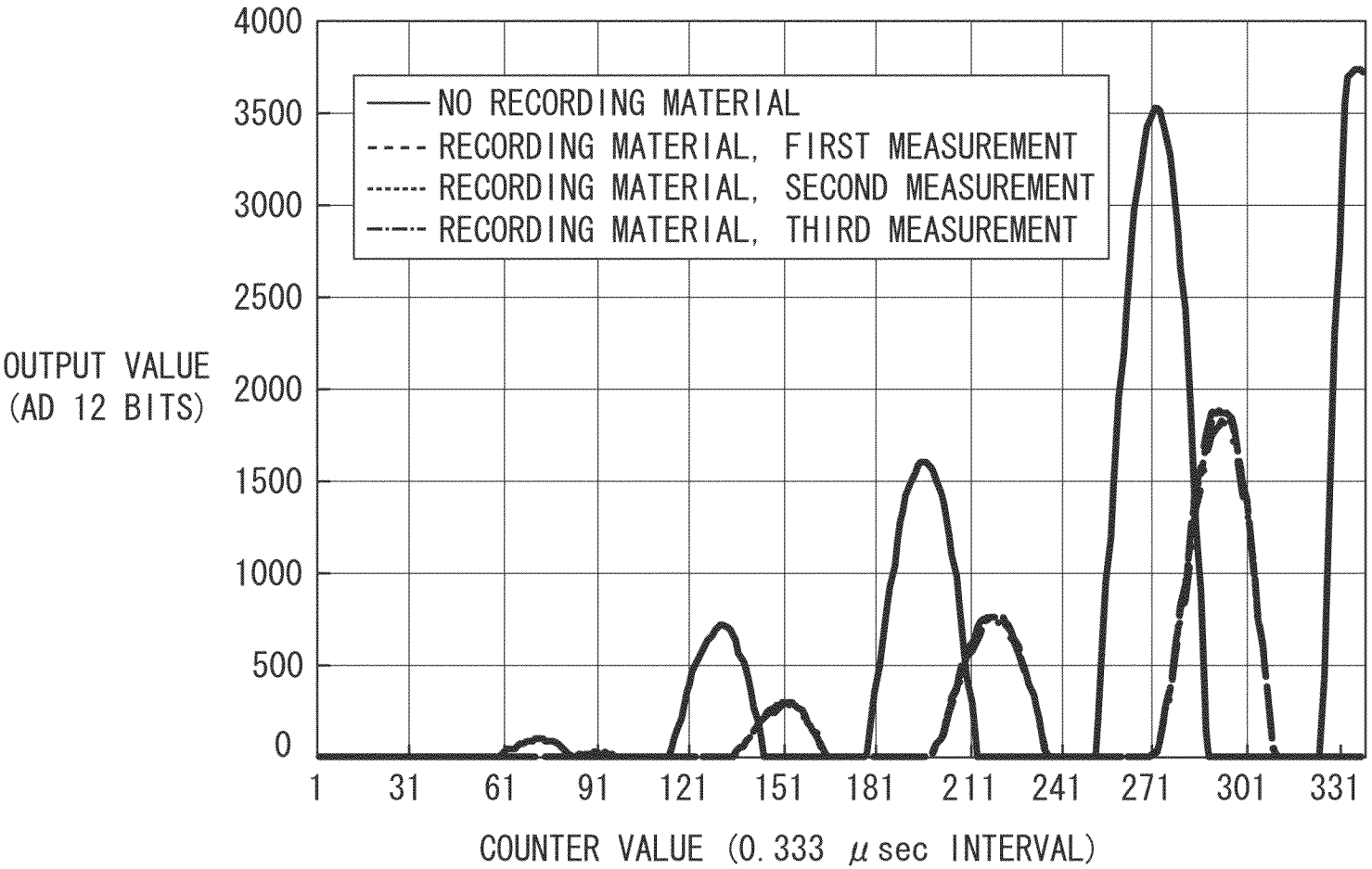
FIGS. 14A and 14B respectively illustrate a waveform of a reception signal of an ultrasonic wave received when a plain paper and a glossy paper is irradiated with an ultrasonic wave.
Figure 14B:
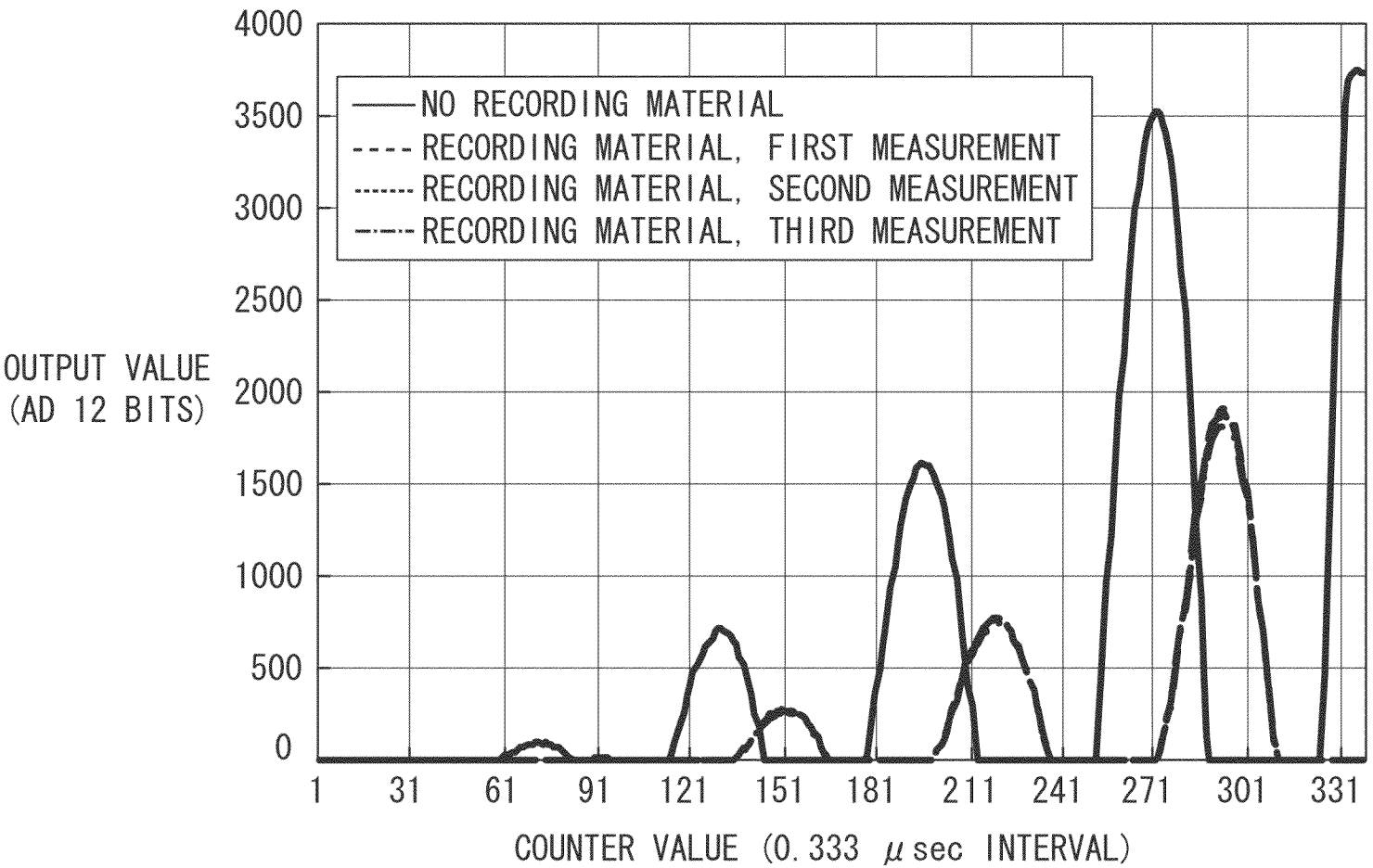

FIGS. 14A and 14B respectively illustrate a waveform of a reception signal of an ultrasonic wave received when a plain paper and a glossy paper is irradiated with an ultrasonic wave. FIGS. 14A and 14B respectively illustrate a waveform of a reception signal of an ultrasonic wave when the recording material P is not present between the ultrasonic wave transmission unit 31 and the ultrasonic wave reception unit 32, and a waveform of a reception signal of an ultrasonic wave transmitted through the recording material P.

FIG. 14A illustrates data for the plain paper. FIG. 14B illustrates data for the gloss paper. In the respective data, three-time measured waveforms are illustrated as a graph in an overlapping manner. A horizontal axis represents a counter value when the data is measured at intervals of 0.333 μsec. A vertical axis represents a value obtained by converting an output voltage by the A-D conversion unit 343.

In the case of the plain paper, when a ratio between a peak value measured when the recording material P is not present between the ultrasonic wave transmission unit 31 and the ultrasonic wave reception unit 32, and a measured peak value of an ultrasonic wave transmitted through the recording material P, is calculated, it can be seen that a variation therein is small.

In the case of the gloss paper, when a ratio between a peak value measured when the recording material P is not present between the ultrasonic wave transmission unit 31 and the ultrasonic wave reception unit 32, and a measured peak value of an ultrasonic wave transmitted through the recording material P, is calculated, it can be seen that a variation therein is smaller than that of the plain paper.

The reason for this is that when different points of the recording material P are measured, the measurement results are different caused by the degree of the surface unevenness of the recording material P. Particularly, in the case of the gloss paper having a smooth surface, since the surface unevenness is low, a change in the measurement value is very small according to the measurement points. With this characteristic, the recording material P may be irradiated with an ultrasonic wave a plurality of times, an ultrasonic wave transmitted through the recording material P may be measured a plurality of times, and a type of the recording material P can be determined based on a variation in the respective measurement results.

A method for detecting a surface property of a recording material P based on a variation between a peak value measured when the recording material P is not present between the ultrasonic wave transmission unit 31 and the ultrasonic wave reception unit 32, and a measured peak value of an ultrasonic wave transmitted through the recording material P, is the same as the flow chart of FIG. 13, therefore a description thereof will not be repeated herein.

In this manner, by measuring the output values of an ultrasonic wave at different points in the recording material P, the surface unevenness of the recording material P can be detected. Therefore, the surface property of the recording material P can be detected with high accuracy in consideration of the unevenness of the recording material P. By using a ratio between the measurement result of an ultrasonic wave when the recording material P is not present between the ultrasonic wave transmission unit 31 and the ultrasonic wave reception unit 32, and the measurement result of an ultrasonic wave transmitted through the recording material P, the influence of a layout variation of the ultrasonic wave transmission unit 31 and the ultrasonic wave reception unit 32 can be reduced. Thus, the surface property of the recording material P can be determined with high accuracy.

In the first to third exemplary embodiments, a method for determining a surface property of the recording material P has been described. In a fourth exemplary embodiment, a method for determining a surface property of the recording material P based on a variation of the peak values of an ultrasonic wave transmitted through the recording material P, and further determining a grammage of the recording material P from the peak values of an ultrasonic wave will be described. A detailed description of the similar configurations (such as the recording material determination apparatus) as in the above first to third exemplary embodiments will not be repeated herein.

Figure 15A:
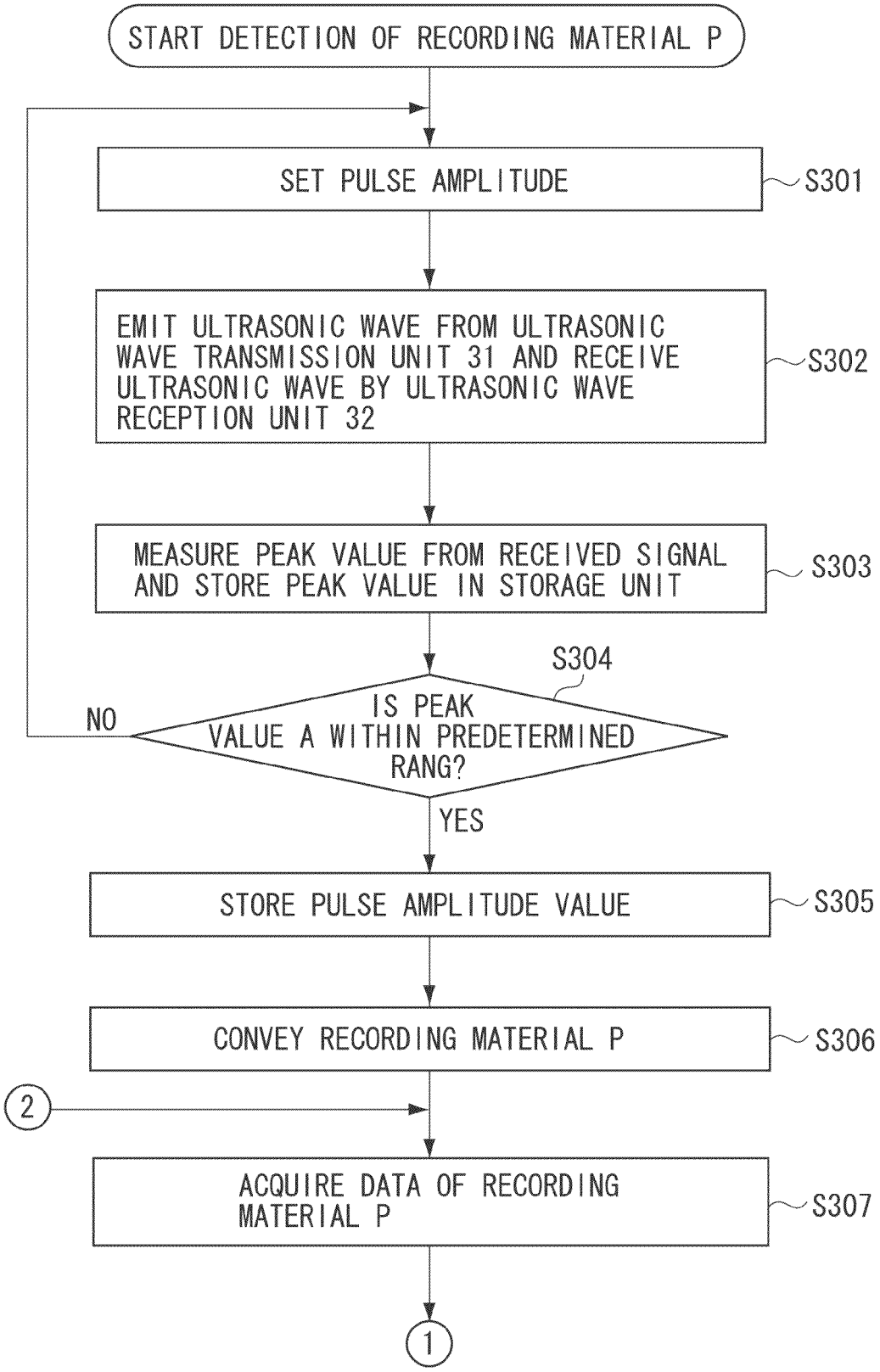
FIG. 15 (15A+15B) is a flowchart illustrating a method for detecting a surface property and a grammage of a recording material P.
Figure 15B:
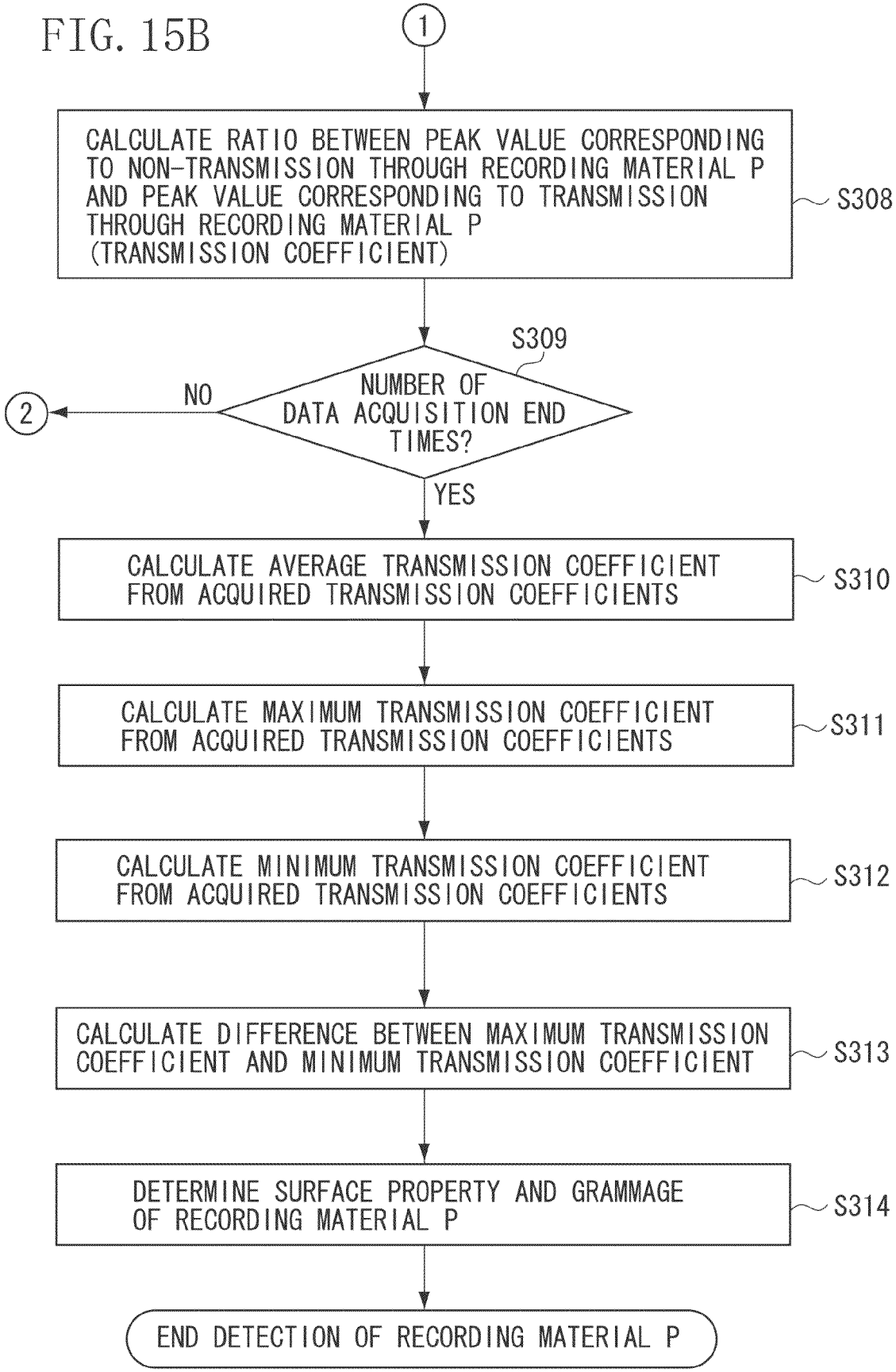

FIG. 15 (15A+15B) is a flow chart illustrating a method for detecting a surface property and a grammage of a recording material P. In step S301, the control unit 10 sets a pulse amplitude for driving the ultrasonic wave transmission unit 31.

A method for setting an amplitude of a signal for driving the ultrasonic wave transmission unit 31 is performed by changing a pulse amplitude value included in the control unit 10. The pulse amplitude value corresponds to an amplification level of a signal level of the amplifier 332. By changing the pulse amplitude, the sound pressure of an ultrasonic wave emitted from the ultrasonic wave transmission unit 31 can be adjusted.

In step S302, the control unit 10 emits an ultrasonic wave by the ultrasonic wave transmission unit 31 when the recording material P is not present between the ultrasonic wave transmission unit 31 and the ultrasonic wave reception unit 32, and an ultrasonic wave is received by the ultrasonic wave reception unit 32. In step S303, the control unit 10 measures a peak value of the received ultrasonic wave. The measurement result is stored in the storage unit 346.

In step S304, the control unit 10 compares the peak value obtained in step S303 and a predetermined value. As a result of the comparison, if the peak value is within a range of ±3% with respect to the predetermined value (YES in step S304), then the control unit 10 ends the adjustment of the pulse amplitude, and the processing proceeds to step S305. If the peak value is not within the range (NO in step S304), then the processing returns to step S301 to adjust the pulse amplitude value that so as to approach the predetermined value in step S301. The range may be set suitably according to the adjustment accuracy and the determination accuracy.

In step S305, the control unit 10 stores the value set in step S301, in the storage unit 346. In step S306, the control unit 10 conveys the recording material P to a position between the ultrasonic wave transmission unit 31 and the ultrasonic wave reception unit 32 of the recording material determination apparatus 30. In step S307, the control unit 10 emits an ultrasonic wave to the recording material P by using the ultrasonic wave transmission unit 31.

An ultrasonic wave transmitted through the recording material P is received by the ultrasonic wave reception unit 32. A peak value is measured from the received signal. The measurement result is stored in the storage unit 346. In step S308, the control unit 10 calculates a ratio between the peak value obtained in step S303 and the peak value obtained in step S307 as a transmission coefficient.

In step S309, the control unit 10 determines whether a number of data acquisition times of the recording material P is a predetermined number of data acquisition end times. In order to determine a surface property of the recording material P, since a variation in the transmission coefficient needs to be calculated, data needs to be measured a plurality of times.

If the number of data acquisition times does not reach the predetermined number of data acquisition end times (NO in step S309), the processing returns to step S307 to acquire data again. In the present exemplary embodiment, the number of data acquisition end times is set to be 30 as an example.

The number of data acquisition end times is the number of times by which the ultrasonic wave transmission unit 31 can transmit an ultrasonic wave a plurality of times and the ultrasonic wave reception unit 32 can receive an ultrasonic wave a plurality of times, while the recording material P is present between the ultrasonic wave transmission unit 31 and the ultrasonic wave reception unit 32. The upper limit of the number of measurement times may be set suitably according to a conveyance speed of the recording material P and an acquisition time for receiving data of an ultrasonic wave.

If the number of data acquisition times reaches the predetermined number of data acquisition end times (YES in step S309), then in step S310, the control unit 10 calculates an average transmission coefficient based on a plurality of calculated transmission coefficients. In step S311, the control unit 10 calculates a maximum transmission coefficient based on the plurality of calculated transmission coefficients. In step S312, the control unit 10 calculates a minimum transmission coefficient based on the plurality of calculated transmission coefficients.

In step S313, the control unit 10 calculates a difference between the maximum transmission coefficient calculated in step S311 and the minimum transmission coefficient calculated in step S312. In step S314, the control unit 10 determines a grammage of the recording material P based on the transmission coefficient average value calculated in step S310, and determines a surface property of the recording material P based on the transmission coefficient difference calculated in step S312. The control unit 10 controls an image forming condition of the image forming apparatus 1 based on the determination results.

In addition, herein, controlling the image forming condition based on the determination results of the grammage and the surface property of the recording material P has been described. However, the present invention is not limited thereto. For example, the image forming condition can also be controlled based on the average transmission coefficient or the transmission coefficient difference.

The image forming conditions include a transfer voltage, a conveyance speed of the recording material, a temperature of the fixing unit, or the like. For example, when the surface property of the recording material P is determined to be the bond paper, the fixability of a developer is low as compared to the image forming condition of the plain paper. Therefore, controls such as reducing the conveyance speed of the recording material P to increase a retention time of the recording material P in a nip of the fixing unit, and increasing a fixing temperature are performed.

When the grammage of the recording material P is determined to be small, the fixing temperature is decreased. When the grammage of the recording material P is determined to be large, the fixing temperature is increased or the conveyance speed of the recording material P is decreased. This is an example in the present exemplary embodiment, and the control method or the determination condition may be changed according to the image forming apparatus.

In the present exemplary embodiment, a method for calculating a maximum value and a minimum value from a plurality of acquired peak values has been described as a method for calculating a variation, and a method for calculating an arithmetic average has been described as a method for calculating an average value. However, the present invention is not limited thereto. For example, a determination can be similarly performed by using a standard deviation, a variance, an integration value, or the like as the variation, and using a medium value, a most frequent value, a sum value, or the like.

In steps S310 to S313, the control unit 10 has determined the surface property and the grammage of the recording material P based on the plurality of calculated transmission coefficients. Since the transmission coefficients used for detection are different according to the peripheral environments, the calculated transmission coefficient is corrected.

A ratio of a pulse amplitude obtained by adjustment in a known environment to a pulse amplitude adjusted under a current environment in step S305 is used as a correction coefficient. This is an example in the present exemplary embodiment. A change in the peripheral environment may be detected, and a coefficient corresponding thereto may be used.

Figure 16:
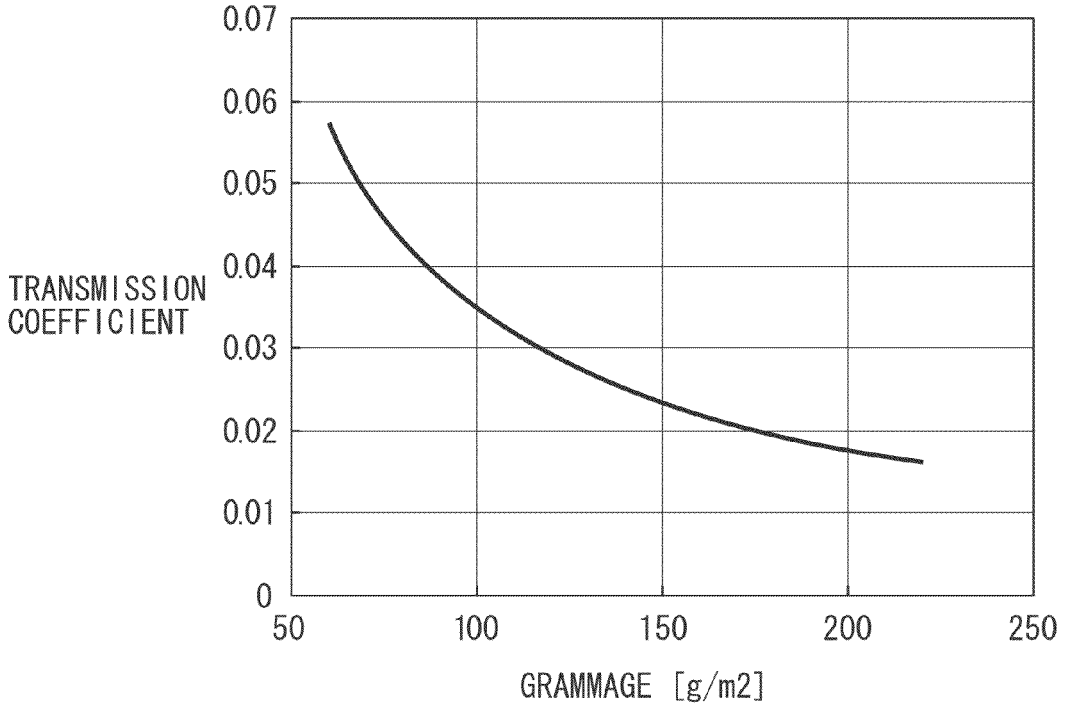
FIG. 16 is a graph illustrating a relationship between a grammage and a transmission coefficient of a recording material P.

A grammage of the recording material P is determined by using the average value of the corrected transmission coefficients, from the relation between the grammage and the transmission coefficient of the recording material P illustrated in FIG. 16. A surface property of the conveyed recording material P is determined by using the maximum value and the minimum value of the corrected transmission coefficient. By performing correction, a determination can be performed on the same condition, therefore the determination can be performed by using one determination threshold value.

In addition, the transmission coefficient value illustrated in FIG. 16 may be a value considering not only a ratio between a peak value of an ultrasonic wave when the recording material P is not present between the ultrasonic wave transmission unit 31 and the ultrasonic wave reception unit 32, and a peak value of an ultrasonic wave transmitted through the recording material P, but also a value considering a difference in the gain of the detection circuit 342 in order to detect a reception signal of the recording material P.

Since the gain is a predetermined constant value, even when it is not considered, the relation between the grammage and the transmission coefficient of the recording material P is not changed. Further, although a method of extracting one peak value by one measurement has been described, a plurality of peak values can be detected by one measurement. It may be possible to extract a plurality of peak values and determine the surface property and the grammage of the recording material P based on a plurality of calculation results. In addition, although a correction of a transmission coefficient has been performed in steps S310 to S313, the correction may also be performed when the transmission coefficient is calculated in step S308.

In the present exemplary embodiment, a method for correcting the peripheral environment by adjusting the pulse amplitude of a signal driving the ultrasonic wave transmission unit 31 has been described. The peripheral environment can be corrected by a predetermined pulse amplitude without using a pulse amplitude adjusting unit.

In a state where the recording material P is not present between the ultrasonic wave transmission unit 31 and the ultrasonic wave reception unit 32, a ratio of the peak value obtained under a known environment to the peak value measured in step S303 is used as a correction coefficient to correct the transmission coefficient. A grammage of the recording material P can be determined by using the corrected transmission coefficient, from the relationship between the grammage and the transmission coefficient of the recording material P illustrated in FIG. 16.

In this manner, by combining two parameters of the average value and the variation of the transmission coefficient, the surface property and the grammage of the recording material P can be determined with high accuracy. Accordingly, instead of using a separate unit or a different control unit, a common unit and a control unit can be used to determine the surface property and the grammage of the recording material. Thus, the cost of the detection apparatus can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2011-177142 filed Aug. 12, 2011 and No. 2012-155506 filed Jul. 11, 2012, which are hereby incorporated by reference herein in their entirety.

What is claimed is:

1. A recording material determination apparatus comprising:

a transmission unit configured to transmit an ultrasonic wave;

a reception unit configured to receive an ultrasonic wave transmitted from the transmission unit and then via a recording material; and a control unit configured to determine a surface property of the recording material based on a plurality of ultrasonic waves transmitted from the transmission unit toward each of different positions of the recording material and received by the reception unit via the recording material.

2. The recording material determination apparatus according to claim 1, wherein the reception unit receives the ultrasonic wave transmitted through the recording material.

3. The recording material determination apparatus according to claim 1, wherein the transmission unit transmits an ultrasonic wave toward a first position of the recording material, and after the recording material being moved, the transmission unit transmits an ultrasonic wave toward a second position of the recording material which is different from the first position.

4. The recording material determination apparatus according to claim 1, wherein the reception unit outputs signal according to the ultrasonic wave being received, and wherein the control unit determines a surface property of the recording material based on the plurality of signals output from the reception unit.

5. The recording material determination apparatus according to claim 4, wherein the control unit determines a surface property of the recording material based on a peak value of the plurality of signals output from the reception unit.

6. The recording material determination apparatus according to claim 4, wherein the control unit determines a surface property of the recording material based on an integral value of the plurality of signals output from the reception unit.

7. The recording material determination apparatus according to claim 4, wherein the control unit determines a surface property of the recording material based on a changing amount of the plurality of signals output from the reception unit.

8. The recording material determination apparatus according to claim 4, wherein the control unit determines a grammage of the recording material based on an average of the plurality of signals output from the reception unit.

9. The recording material determination apparatus according to claim 4, wherein the control unit determines a surface property of the recording material based on a difference value between a maximum value and a minimum value of the plurality of signals output from the reception unit.

10. A recording material determination apparatus comprising:

a transmission unit configured to transmit an ultrasonic wave;

a reception unit configured to receive an ultrasonic wave transmitted from the transmission unit; and a control unit configured to measure an output value of a reception signal of an ultrasonic wave received by the reception unit, wherein the control unit measures a first output value by causing the transmission unit to transmit an ultrasonic wave in a state where no recording material is present between the transmission unit and the reception unit, measures a plurality of second output values by transmitting an ultrasonic wave from the transmission unit in a state where a recording material is present between the transmission unit and the reception unit, and determines the recording material based on the first output value and the second output values.

11. The recording material determination apparatus according to claim 10, wherein the control unit determines the recording material based on a ratio of the first output value and the second output values.

12. The recording material determination apparatus according to claim 10, wherein the output value is a peak value of a reception signal of an ultrasonic wave.

13. The recording material determination apparatus according to claim 10, wherein the output value is an integration value of a reception signal of an ultrasonic wave.

14. The recording material determination apparatus according to claim 10, wherein the control unit determines a surface property of the recording material based on a ratio of the first output value and the second output values.

15. The recording material determination apparatus according to claim 10, wherein the control unit determines the recording material by determining whether a ratio of the first output value and the second output values exceeds a threshold value for determining the recording material.

16. The recording material determination apparatus according to claim 10, wherein the control unit measures the second output values by causing the transmission unit to transmit an ultrasonic wave a plurality of times.

17. The recording material determination apparatus according to claim 10, wherein the control unit measures a third output value by transmitting an ultrasonic wave from the transmission unit in a state where no recording material is present between the transmission unit and the reception unit in a known environment, and corrects a ratio of the first output value to the second output values based on a ratio of the first output value to the third output value.

18. The recording material determination apparatus according to claim 10, further comprising:

a transmission unit configured to transmit a driving signal for transmitting an ultrasonic wave from the transmission unit; and an adjustment unit configured to adjust a pulse amplitude of the driving signal, wherein the control unit measures a first pulse amplitude value of an ultrasonic wave adjusted by transmitting an ultrasonic wave from the transmission unit in a state where no recording material is present between the transmission unit and the reception unit in a current environment, measures a second pulse amplitude value of an ultrasonic wave adjusted by transmitting an ultrasonic wave from the transmission unit in a state where no recording material is present between the transmission unit and the reception unit in a known environment, and corrects a ratio of the first output value to the second output values based on a ratio of the first pulse amplitude value to the second pulse amplitude value.

19. The recording material determination apparatus according to claim 10, wherein the control unit determines a grammage of the recording material based on the second output values.

20. An image forming apparatus comprising:

an image forming unit configured to form an image;

a transmission unit configured to transmit an ultrasonic wave; and a reception unit configured to receive an ultrasonic wave transmitted from the transmission unit and then via a recording material, a control unit configured to control an image forming condition of the image forming unit based on a changing amount of a plurality of ultrasonic waves transmitted from the transmission unit toward each of different positions of the recording material and received by the reception unit via the recording material.

21. The image forming unit according to claim 20, the image forming unit further comprising:

a conveyance unit configured to convey a recording material, wherein the transmission unit transmits an ultrasonic wave toward the first position of the recording material, and after the recording material moved by being conveyed by the conveyance unit, the transmission unit transmits an ultrasonic wave toward the second position of the recording material which is different from the first position.

22. An image forming apparatus comprising:

an image forming unit configured to form an image;

a transmission unit configured to transmit an ultrasonic wave;

a reception unit configured to receive an ultrasonic wave transmitted from the transmission unit; and a control unit configured to measure an output value of a reception signal of an ultrasonic wave received by the reception unit, wherein the control unit measures a first output value by transmitting an ultrasonic wave from the transmission unit in a state where no recording material is present between the transmission unit and the reception unit, measures a plurality of second output values by transmitting an ultrasonic wave from the transmission unit in a state where a recording material is present between the transmission unit and the reception unit, and controls an image forming condition of the image forming unit based on the first output value and the second output values.

* * * * *